US009828746B2

(12) United States Patent
Takebayashi et al.

(10) Patent No.: US 9,828,746 B2
(45) Date of Patent: Nov. 28, 2017

(54) HYDRAULIC DRIVING SYSTEM FOR CONSTRUCTION MACHINE

(71) Applicant: Hitachi Construction Machinery Tierra Co., Ltd., Bunkyo-ku, Shiga (JP)

(72) Inventors: Yoshifumi Takebayashi, Koka (JP); Kiwamu Takahashi, Koka (JP); Kazushige Mori, Koka (JP); Natsuki Nakamura, Koka (JP)

(73) Assignee: Hitachi Construction Machinery Tierra Co., Ltd., Koka-shi (JP)

( * ) Notice: Subject to any disclaimer, the term of this patent is extended or adjusted under 35 U.S.C. 154(b) by 363 days.

(21) Appl. No.: 14/423,868

(22) PCT Filed: Oct. 8, 2013

(86) PCT No.: PCT/JP2013/077364
§ 371 (c)(1),
(2) Date: Feb. 25, 2015

(87) PCT Pub. No.: WO2014/061507
PCT Pub. Date: Apr. 24, 2014

(65) Prior Publication Data
US 2015/0240455 A1 Aug. 27, 2015

(30) Foreign Application Priority Data
Oct. 17, 2012 (JP) ..... 2012-230071

(51) Int. Cl.
*E02F 9/22* (2006.01)
*F04B 49/08* (2006.01)
(Continued)

(52) U.S. Cl.
CPC ..... *E02F 9/2232* (2013.01); *E02F 3/325* (2013.01); *E02F 3/964* (2013.01); *E02F 9/02* (2013.01);
(Continued)

(58) Field of Classification Search
CPC ..... F15B 11/161; F15B 11/163; E02F 9/2232
(Continued)

(56) References Cited

U.S. PATENT DOCUMENTS 5,398,507 A * 3/1995 Akiyama ..... E02F 9/2232 60/433
2009/0031719 A1 2/2009 Tsuruga et al.
2013/0055705 A1* 3/2013 Mori ..... E02F 9/2232 60/459

FOREIGN PATENT DOCUMENTS

JP 64-6501 A 1/1989
JP 4-19406 A 1/1992
(Continued)

OTHER PUBLICATIONS

International Preliminary Report on Patentability (PCT/IB/338 & PCT/IB/373) dated Apr. 30, 2015, including English translation of Document C2 (Japanese-language Written Opinion (PCT/ISA/237)) previously filed on Feb. 25, 2015 (six (6) pages.
(Continued)

*Primary Examiner* — Thomas E Lazo
(74) *Attorney, Agent, or Firm* — Crowell & Moring LLP

(57) ABSTRACT

Control valves 100*f*, 100*g*, and 100*h* that reduce flow passage areas of parallel hydraulic fluid lines 41*f*, 41*g*, and 41*h* respectively when operating devices 34*a*, 34*b* for traveling are operated, are each disposed in the parallel hydraulic fluid line 41*f*, 41*g*, or 41*h* so that if saturation occurs during combined operations control likely to generate a significant difference in load pressure between any two
(Continued)

actuators, the control valve prevents full closing of a pressure compensating valve lower in load pressure and thus prevents a slowdown and stop of the actuator undergoing the lower load pressure, and so that if saturation occurs during combined operations control likely to generate a particularly significant difference in load pressure between any two actuators, the control valve ensures a necessary supply of hydraulic fluid to the actuator higher in load pressure, thereby preventing a slowdown and stop of the actuator higher in load pressure.

6 Claims, 13 Drawing Sheets

(51) Int. Cl.

| | |
|---|---|
| ***F04B 49/22*** | (2006.01) |
| ***F15B 11/16*** | (2006.01) |
| ***E02F 3/96*** | (2006.01) |
| ***E02F 9/02*** | (2006.01) |
| ***E02F 3/32*** | (2006.01) |

(52) U.S. Cl.
CPC ..... *E02F 9/2203* (2013.01); *E02F 9/2225* (2013.01); *E02F 9/2267* (2013.01); *E02F 9/2285* (2013.01); *E02F 9/2296* (2013.01); *F04B 49/08* (2013.01); *F04B 49/22* (2013.01); *F15B 11/161* (2013.01); *F15B 11/163* (2013.01); *F15B 2211/20546* (2013.01); *F15B 2211/30535* (2013.01); *F15B 2211/329* (2013.01); *F15B 2211/41509* (2013.01); *F15B 2211/428* (2013.01); *F15B 2211/7142* (2013.01)

(58) Field of Classification Search
USPC ..... 60/421
See application file for complete search history.

(56) References Cited

FOREIGN PATENT DOCUMENTS

| | | | | | |
|---|---|---|---|---|---|
| JP | 7-62694 | A | | 3/1995 | |
| JP | 7-76861 | A | | 3/1995 | |
| JP | 2005-226678 | A | | 8/2005 | |
| JP | 2007-24103 | A | | 2/2007 | |
| JP | 2010-101095 | A | | 5/2010 | |
| JP | 2011-196439 | A | | 10/2011 | |
| JP | 2011196439 | A | * | 10/2011 | |
| JP | 2011-247301 | A | | 12/2011 | |
| JP | 2011247301 | A | * | 12/2011 | ..... E02F 9/2232 |

OTHER PUBLICATIONS

Extended European Search Report issued in counterpart European Application No. 13847113.1 dated Apr. 28, 2016 (8 pages).
International Search Report (PCT/ISA/210) dated Nov. 12, 2013 with English translation (five pages).
Japanese-language Written Opinion (PCT/ISA/237) dated Nov. 12, 2013 (three pages).

* cited by examiner

HYDRAULIC DRIVING SYSTEM FOR CONSTRUCTION MACHINE

TECHNICAL FIELD

The present invention relates generally to hydraulic driving systems for construction machines such as hydraulic excavators. More particularly, the invention is directed to hydraulic driving systems for construction machines, each of the systems being configured to subject a delivery rate of hydraulic fluid from a hydraulic pump to load-sensing control so that a fluid delivery pressure of the hydraulic pump becomes higher by a target differential pressure than a load pressure of an actuator to which the highest load pressure is to be assigned among a plurality of actuators.

BACKGROUND ART

Some of the hydraulic driving systems for construction machines such as hydraulic excavators are designed to control a flow rate of a hydraulic fluid as delivered from a hydraulic pump (a main pump). Accordingly, a fluid delivery pressure of the hydraulic pump becomes higher by a target differential pressure than a load pressure of an actuator to which the highest load pressure is to be assigned among a plurality of actuators. Such flow rate control is called load-sensing control. The hydraulic driving systems in which the load-sensing control is performed are adapted to maintain a predetermined differential pressure across each of a plurality of flow control valves via a pressure compensating valve disposed for the flow control valve independently. During combined operations control for simultaneously driving the actuators, the hydraulic driving systems can thus supply the hydraulic fluid to the actuators at a ratio commensurate with an opening area of each flow control valve, irrespective of a magnitude of the actuator load pressures.

Patent Document 1, for example, describes such a hydraulic driving system adapted to perform the load-sensing control. The hydraulic driving system described in Patent Document 1 is configured so that a differential pressure (hereinafter referred to as the load-sensing differential pressure) between a fluid delivery pressure of a hydraulic pump and a load pressure of an actuator to which the highest load pressure is to be assigned among a plurality of actuators is guided as a target compensation differential pressure to pressure-receiving portions constructed so as to operate pressure compensating valves in a direction to increase in opening area. The hydraulic driving system is also configured so that the target compensation differential pressure across each of the pressure compensating valves is set to be the same value equivalent to the load-sensing differential pressure. Thus, a differential pressure across each of a plurality of flow control valves is held at the load-sensing differential pressure level. During combined operations control for simultaneously driving the actuators, therefore, even if the fluid delivery pressure of the hydraulic pump is insufficient (this state is hereinafter referred to as saturation), a decrease in load-sensing differential pressure according to a particular degree of the saturation uniformly reduces the target compensation differential pressures of the pressure compensating valves (i.e., the differential pressures across the flow control valves), thus enabling a delivery rate of the hydraulic fluid from the hydraulic pump to be redistributed to a ratio of the flow rates demanded from the actuators.

In addition, the pressure compensating valves of the hydraulic driving systems in which the load-sensing control is performed are usually configured so that as described in Patent Document 1, the valve will fully close when a spool operates in a direction to reduce an opening area of the valve and reaches a stroke end of the spool.

In contrast to the above, Patent Document 2 describes a hydraulic driving system configured so as not to fully close a pressure compensating valve even after a spool has operated in a direction to reduce an opening area of the valve and reached a stroke end of the spool.

PRIOR ART DOCUMENTS

Patent Documents

Patent Document 1: JP-2007-24103-A
Patent Document 2: JPH7-76861-A

SUMMARY OF THE INVENTION

Problems to be Solved by the Invention

The following problems, however, exist in the above conventional art.

As discussed above, the conventional hydraulic driving systems in which the load-sensing control is performed, such as the one described in Patent Document 1, each include pressure compensating valves, whereby the system can supply a hydraulic fluid to a plurality of actuators at a ratio commensurate with an opening area of flow control valves, irrespective of the load pressures applied during the combined operations control for simultaneously driving the actuators.

In addition, for the hydraulic driving system described in Patent Document 1, the load-sensing control differential pressure is set as a target compensation differential pressure. Thus, even if saturation occurs during the combined operations control for simultaneously driving the plurality of actuators, a flow rate of the hydraulic fluid delivered from a hydraulic pump can be redistributed at a ratio of the flow rates demanded from the actuators.

For the hydraulic driving system described in Patent Document 1, however, since the pressure compensating valves are each constructed so as to fully close at the stroke end of the spool as operated in the direction to reduce the opening area of the valve, if saturation occurs during the combined operations control likely to generate a significant difference in load pressure between any two actuators, the pressure compensating valve lower in load pressure may be excessively reduced in opening area or excessively closed. The actuator undergoing the lower load pressure is therefore likely to slow down and/or even stop operating.

For the hydraulic driving system described in Patent Document 2, since the pressure compensating valve is constructed so as not to fully close at the stroke end of the spool as operated in the direction to reduce the opening area of the valve, even if saturation occurs during such combined operations control as discussed above, the pressure compensating valve lower in load pressure does not excessively reduce the opening area, nor does the valve fully close. A slowdown and/or stop of an actuator lower in load pressure can therefore be prevented.

The hydraulic driving system described in Patent Document 2, however, has a problem in that if saturation occurs during the combined operations control likely to generate a particularly significant difference in load pressure between any two actuators, since the pressure compensating valve of the actuator lower in load pressure does not close, a large portion of the fluid delivered from a main pump may be absorbed by the actuator lower in load pressure. The actuator undergoing the higher load pressure may therefore slow down and/or even stop operating.

For example, when either a boom, arm, or bucket hydraulic cylinder of a construction machine is driven for a change in a posture of a front working implement during slope climbing, a very high load pressure is usually applied to a track motor and a particularly significant difference in load pressure occurs between the track motor and the actuator (hydraulic cylinder) of the front working implement. Hence a hydraulic fluid delivered from a hydraulic pump may flow into the actuator of the front working implement that undergoes the lower load pressure, and the vehicle may stop traveling.

In addition, even when the vehicle is traveling along a level ground surface, if a blade is abruptly operated for a change in a posture of the blade during traveling, a particularly significant difference in load pressure between the track motor and the blade cylinder occurs as in the above case. In this case, a large portion of the hydraulic fluid delivered from the hydraulic pump may flow into the blade cylinder, which is the actuator having the lower load pressure. This situation may lead to a slowdown of traveling and undermine an operation feeling.

The above drawbacks may also occur with elements other than the track motor. For example, a standby actuator provided on an attachment such as a crusher used in exchange for the bucket tends to increase in load pressure and a difference in load pressure increases particularly during the combined operations control where the standby actuator is driven simultaneously with any other actuator, for example the hydraulic cylinder of the boom, arm, or bucket. These increases in load pressure are also likely to cause problems similar to those described above.

An object of the present invention is to provide a hydraulic driving system for a construction machine in which the load-sensing control is performed. If saturation occurs during combined operations control that generates a significant difference in load pressure between any two actuators, the hydraulic driving system prevents full closing of a pressure compensating valve undergoing the lower load pressure, and hence a slowdown and stop of the actuator lower in load pressure. In addition, if saturation occurs during the combined operations control that generates a particularly significant difference in load pressure between any two actuators, the hydraulic driving system ensures a necessary supply of hydraulic fluid to the actuator higher in load pressure, thereby preventing a slowdown and stop of the actuator higher in load pressure, and thus providing appropriate combined-operations controllability.

Means for Solving the Problems

To achieve the above object, in an aspect of the present invention, a hydraulic driving system for a construction machine includes: a variable-displacement type of hydraulic pump; a plurality of actuators each driven by a hydraulic fluid delivered from the hydraulic pump; a plurality of flow control valves that each control a flow rate of the hydraulic fluid supplied from the hydraulic pump to a corresponding one of the actuators; a plurality of operating devices disposed in association with the actuators, each of the operating devices including a remote control valve configured to generate an operating pilot pressure for driving a corresponding one of the flow control valves; a plurality of pressure compensating valves each for controlling a differential pressure across a corresponding one of the flow control valves independently; and a pump control unit for controlling a capacity of the hydraulic pump by means of load-sensing control so that a fluid delivery pressure of the hydraulic pump becomes higher by a target differential pressure than a load pressure of an actuator to which the highest load pressure is to be assigned among the plurality of actuators. In the hydraulic driving system, the pressure compensating valves are each a pressure compensating valve of a type not fully closing at a stroke end of the valve as operated in a direction to decrease in opening area. The plurality of actuators include a specific actuator that undergoes a higher load pressure during combined operations control when the specific actuator is driven simultaneously with actuators other than the specific actuator. A control valve is disposed in hydraulic fluid line portions upstream or downstream relative to a pressure compensating valve of the actuator other than the specific actuator, the control valve reducing a flow passage area of the hydraulic fluid line portion upon operation of a specific operating device, among the plurality of operating devices, that relates to the specific actuator.

When pressure compensating valves each of the type not fully closing at the stroke end of the valve as operated in the direction to decrease in opening area are arranged in this way as the plurality of pressure compensating valves, even if saturation occurs during the combined operations control that generates a significant difference in load pressure between any two actuators, full closing of a pressure compensating valve undergoing the lower load pressure is prevented and hence the actuator lower in load pressure can be prevented from slowing down and stopping.

In addition, a control valve is disposed in fluid line portions upstream or downstream relative to a pressure compensating valve of the actuators other than the specific actuator. The specific actuator is an actuator which undergoes a higher load pressure during simultaneous driving with another actuator by combined operations control. The control valve reduces a flow passage area of the hydraulic fluid line portion in response to the operation of a specific operating device, one of the plurality of operating devices that relates to the specific actuator. Thus, when the specific operating device is operated, the control valve reduces the flow passage area of the hydraulic fluid line portion. Accordingly, if saturation occurs during a combined operations control in which the specific actuator and the actuators other than the specific actuator have a significant difference in load pressure, then a flow rate of the hydraulic fluid supplied to the actuator other than the specific actuator, or the actuator undergoing the lower load pressure, is suppressed. This ensures a necessary supply of hydraulic fluid to the specific actuator, or the actuator undergoing the higher load pressure, thereby prevent a slowdown or stop of the specific actuator, or the actuator undergoing the higher load pressure, and thus provide appropriate combined-operations controllability.

The plurality of pressure compensating valves are each disposed in a corresponding one of a plurality of parallel hydraulic fluid lines branching from a supply fluid line connected to the hydraulic pump, and the hydraulic fluid line portion with the control valve disposed therein is one of the parallel hydraulic fluid lines and is where, for example, the pressure compensating valve relating to the actuator other than the specific actuator is disposed.

Accordingly, when the specific operating device is operated, a flow rate of the hydraulic fluid supplied only to the actuator corresponding to the parallel hydraulic fluid line will be suppressed and flow rates of the fluid supplied to the other actuators will not be suppressed. Controllability can therefore be prevented from decreasing, even if part of the other actuators decreases in speed during the combined operations control of the specific actuator and at least one of the other actuators.

The hydraulic fluid line portion with the control valve disposed therein may be a portion of the supply fluid line, and the hydraulic fluid line portion may lie upstream relative to a branching position of the parallel hydraulic fluid lines having the pressure compensating valves of the other actuators arranged therein.

Thus when the actuator other than the specific actuator is present in plurality, flow rates of the hydraulic fluid supplied to the actuators other than the specific actuator will also be suppressed with one control valve and the advantageous effects described above will be obtained. This will in turn reduce the number of constituent parts needed and yield the effects less expensively.

The hydraulic driving system further includes a shuttle valve serving as an operations detector to detect the operations on a specific operating device, and the shuttle valve detects an operating pilot pressure generated by the remote control valve of the specific operating device and outputs a hydraulic signal commensurate with the detected pilot pressure. The control valve in this case can be a hydraulic fluid pressure control valve that controls the fluid pressure according to the particular hydraulic signal. The hydraulic driving system additionally includes a pressure sensor that detects the operating pilot pressure generated by the remote control valve of the specific operating device and then outputs an electrical signal commensurate with the operating pilot pressure. The control valve in this case can be a solenoid-operated control valve that operates in accordance with the electrical signal.

The hydraulic driving system may further include a manual selector adapted to be switched between its first position and its second position. The system may also include a controller. When the manual selector is in the first position, the controller activates a function of the control valve that reduces the flow passage area of the hydraulic fluid line portion in response to the operation of the specific operating device. When the manual selector is switched to the second position, the controller deactivates the function of the control valve that reduces the flow passage area of the hydraulic fluid line portion in response to the operation of the specific operating device.

Thus an operator can freely select whether to use a function of the present invention according to his or her needs or preference.

The specific actuator is for example a track motor that drives a track structure of the construction machine, and each of the actuators other than the specific actuator is for example one of the hydraulic cylinders which actuate the front working implement of the construction machine, or otherwise the blade cylinder that actuates the blade.

Thus during climbing of an upslope, when any one of the hydraulic cylinders is driven for a change in a posture of the front working implement, the control valve suppresses a flow rate of the hydraulic fluid supplied to the particular hydraulic cylinder. A necessary amount of fluid is then reliably supplied to the track motor, a slowdown and stop of traveling are prevented, and appropriate combined-operations controllability is consequently obtained. In addition, if or when the blade is abruptly operated for a change in a posture of the blade during traveling along a level ground surface, the control valve suppresses a flow rate of the hydraulic fluid supplied to the blade cylinder. A necessary amount of fluid is then reliably supplied to the track motor, a slowdown of traveling is prevented, and an operation feeling is improved.

Effects of the Invention

In accordance with the present invention, in the hydraulic driving system in which the load-sensing control is performed, if saturation occurs during the combined operations control that generates a significant difference in load pressure between any two actuators, the system prevents a slowdown and stop of the actuator with the lower load pressure by preventing full closing of the pressure compensating valve with the lower load pressure. Additionally, if saturation occurs during the combined operations control likely to generate a particularly significant difference in load pressure between any two actuators, the hydraulic driving system ensures the necessary supply of hydraulic fluid to the actuator higher in load pressure, thereby preventing a slowdown and stop of the actuator higher in load pressure, and thus providing appropriate combined-operations controllability.

MODES FOR CARRYING OUT THE INVENTION

Hereunder, embodiments of the present invention will be described in accordance with the accompanying drawings.

Hydraulic Excavator

Figure 2:
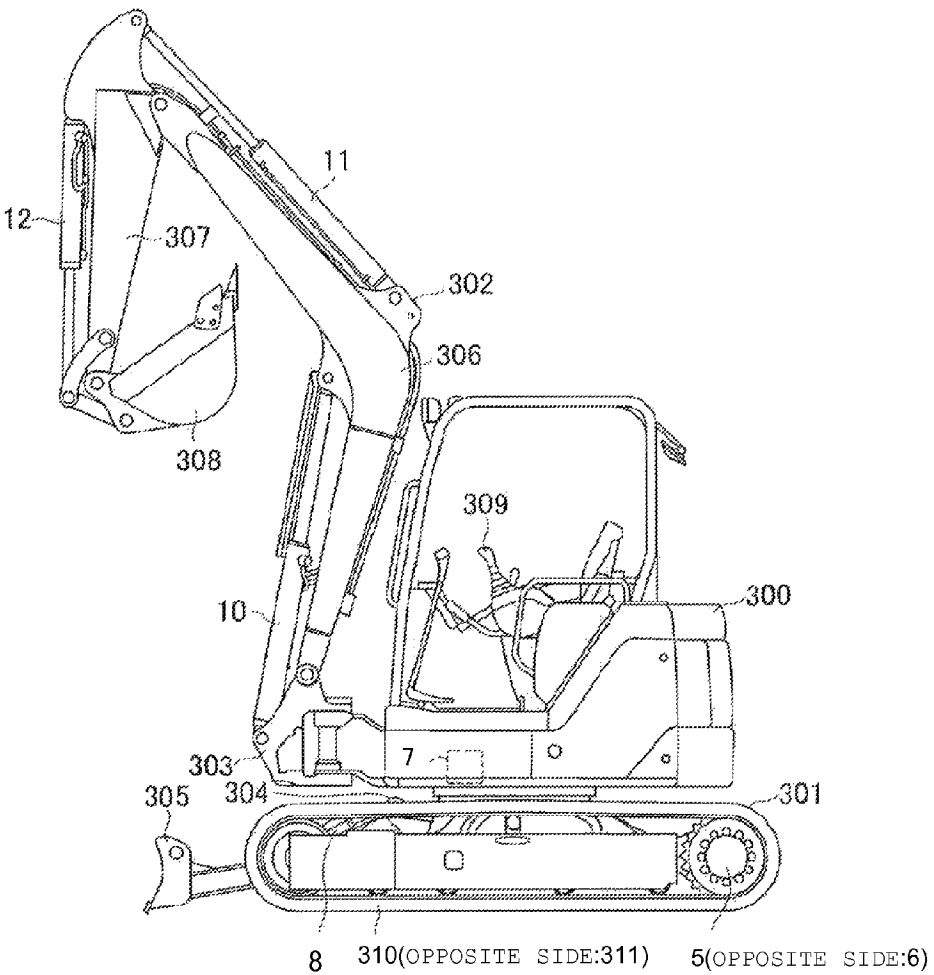
FIG. 2 is an external view of the hydraulic excavator, a construction machine.

An appearance of a hydraulic excavator is shown in FIG. 2.

Referring to FIG. 2, the hydraulic excavator well known as a construction machine includes an upper swing structure 300, a lower track structure 301, and a swing type of front working implement 302, and the front working implement 302 includes a boom 306, an arm 307, and a bucket 308. The upper swing structure 300 is adapted to swing above the lower track structure 301 by rotation of a swing motor 7. A swing post 303 is mounted on a front section of the upper swing structure 300, and the front working implement 302 is connected to the swing post 303 so as to move upward and downward. The swing post 303 is adapted to turn horizontally with respect to the upper swing structure 300 by telescopic movements of a swing cylinder 9 (shown in FIG. 1A). The boom 306, the arm 307, and the bucket 308, of the front working implement 302, are adapted to turn vertically by telescopic movements of a boom cylinder 10, an arm cylinder 11, and a bucket cylinder 12, respectively. The lower track structure 301 includes a center frame 304, to which is connected a blade 305 that operates vertically by telescopic movements of a blade cylinder 8 (see FIG. 1A). The lower track structure 301 travels while driving a left crawler 310 and a right crawler 311 by rotation of track motors 5 and 6, respectively.

First Embodiment

Figure 1A:
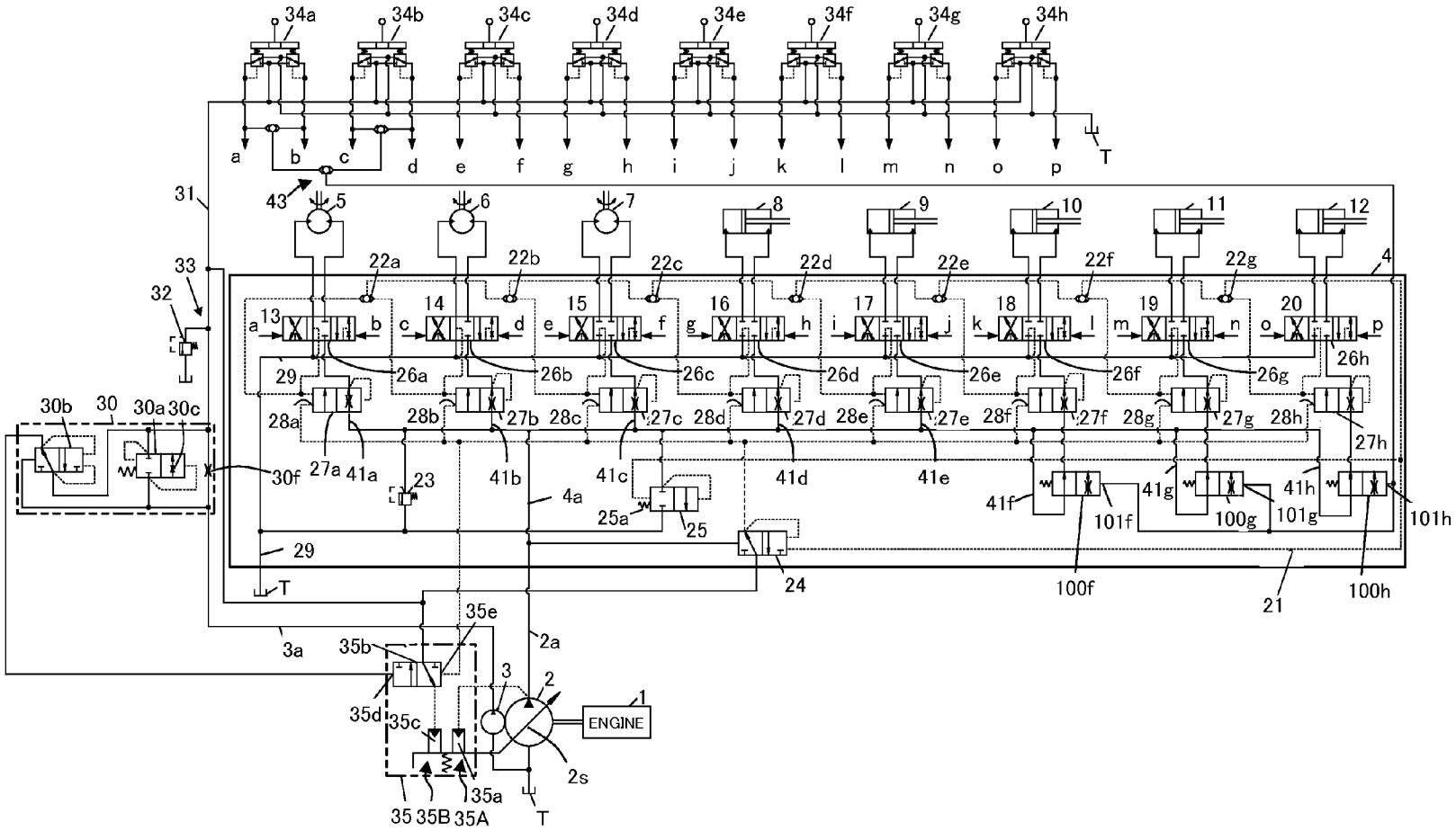
FIG. 1A is a diagram showing a hydraulic driving system of a hydraulic excavator according to a first embodiment of the present invention.

A hydraulic driving system according to a first embodiment of the present invention is shown in FIG. 1A.

Basic Configuration

First, a basic configuration of the hydraulic driving system according to the present embodiment is described.

The hydraulic driving system according to the present embodiment includes: an engine 1; a main hydraulic pump (hereinafter, referred to simply as main pump) 2 that is driven by the engine 1; a pilot pump 3 that operates in association with the main pump 2 and is driven by the engine 1; a plurality of actuators 5, 6, 7, 8, 9, 10, 11, and 12 that are each driven by a hydraulic fluid delivered from the main pump 2, more specifically the actuators being a left track motor 5, a right track motor 6, a swing motor 7, a blade cylinder 8, a swing cylinder 9, a boom cylinder 10, an arm cylinder 11, and a bucket cylinder 12; and a control valve 4. The hydraulic excavator employing the hydraulic driving system according to the present embodiment is a hydraulic mini-excavator, for example.

The control valve 4 includes: a plurality of valve sections 13, 14, 15, 16, 17, 18, 19, and 20 that are each connected to a supply fluid line 2*a* of the main pump 2 and independently control a direction and flow rate of the hydraulic fluid supplied from the main pump 2 to a corresponding one of the actuators; a plurality of shuttle valves 22*a*, 22*b*, 22*c*, 22*d*, 22*e*, 22*f*, and 22*g* that each select a maximum load pressure PLmax, the highest of load pressures upon the actuators 5, 6, 7, 8, 9, 10, 11, 12, and outputs the maximum load pressure to a signal fluid line 21; a main relief valve 23 connected to an intra-valve supply fluid line 4*a* connected to the supply fluid line 2*a* of the main pump 2, the valve 23 being disposed to limit a maximum pump pressure that is a maximum fluid delivery pressure of the main pump 2; a differential-pressure reducing valve 24 connected to a pilot hydraulic fluid source 33 described later herein, and adapted to receive pressures of the supply fluid line 4*a* and the signal fluid line 21 as pressure signal inputs, and then output an absolute pressure that is a differential pressure PLS between a fluid delivery pressure (pump pressure) Pd of the main pump 2 and the maximum load pressure PLmax; and an unloading valve 25 connected to the intra-valve supply fluid line 4*a* and functioning to receive the pressures of the supply fluid line 4*a* and the signal fluid line 21 as pressure signal inputs, then after the differential pressure PLS between the pump pressure Pd and the maximum load pressure PLmax has exceeded a constant value preset via a spring 25*a*, return a portion of the delivered fluid flow rate within the main pump 2 to a tank T, and maintain the differential pressure PLS at a level equal to or less than the constant value preset via the spring 25*a*. The unloading valve 25 and the main relief valve 23 are connected at respective exit ends to an intra-valve tank fluid line 29 and further connected to the tank T via the fluid line 29.

The valve section 13 includes a flow control valve 26*a* and a pressure compensating valve 27*a*, the valve section 14 includes a flow control valve 26*b* and a pressure compensating valve 27*b*, the valve section 15 includes a flow control valve 26*c* and a pressure compensating valve 27*c*, the valve section 16 includes a flow control valve 26*d* and a pressure compensating valve 27*d*, the valve section 17 includes a flow control valve 26*e* and a pressure compensating valve 27*e*, the valve section 18 includes a flow control valve 26*f* and a pressure compensating valve 27*f*, the valve section 19 includes a flow control valve 26*g* and a pressure compensating valve 27*g*, the valve section 20 includes a flow control valve 26*h* and a pressure compensating valve 27*h*. Each of the pressure compensating valves 27*a* to 27*h* is disposed in a corresponding independent one of a plurality of parallel hydraulic fluid lines 41*a* to 41*f* branching, at an upstream side of the flow control valves 26*a* to 26*h*, from the intra-valve supply fluid line 4*a* connected to the supply fluid line 2*a* of the main pump 2.

The flow control valves 26*a* to 26*h* independently control the direction and flow rate of the hydraulic fluid supplied from the main pump 2 to the actuators 5 to 12, respectively. The pressure compensating valves 27*a* to 27*h* independently control differential pressures existing across the flow control valves 26*a* to 26*h*, respectively.

The pressure compensating valves 27*a* to 27*h* each include one of valve-opening end pressure receiving portions 28*a*, 28*b*, 28*c*, 28*d*, 28*e*, 28*f*, 28*g*, and 28*h* for setting target differential pressures. The output pressure from the differential pressure reducing valve 24 is guided to the pressure receiving portions 28*a* to 28*h*, and then a target compensation differential pressure is set according to the particular absolute pressure of the differential pressure PLS between the hydraulic pump pressure Pd and the maximum load pressure PLmax. The absolute differential pressure is hereinafter referred to as the absolute pressure PLS. In this way, each of the individual differential pressures across a corresponding one of the flow control valves 26*a* to 26*h* is controlled to equal the same value of differential pressure PLS, so that the pressure compensating valves 27*a* to 27*h* provide pressure control to ensure that each differential pressure across the corresponding one of the flow control valves 26*a* to 26*h* equals the differential pressure PLS between the hydraulic pump pressure Pd and the maximum load pressure PLmax. Thus during the combined operations control where a plurality of actuators are driven at the same time, the fluid delivery rate of the main pump 2 can be distributed according to a particular opening-area ratio of the flow control valves 26*a* to 26*h*, irrespective of a magnitude of the load pressures of the actuators 5 to 12, thereby to provide appropriate combined-operations controllability. In addition, under a saturation state causing the fluid delivery rate of the main pump 2 to fall short of a demanded flow rate, the differential pressure PLS decreases according to a particular degree of the undersupply. Accordingly, each differential pressure across the corresponding one of the flow control valves 26*a* to 26*h* controlled by the pressure compensating valves 27*a* to 27*h*, respectively, decreases at the same rate and thus the flows of the fluid through the flow control valves 26*a* to 26*h* also decrease at the same time. Even under these situations, appropriate combined-operations controllability can be obtained since the fluid delivery rate of the main pump 2 is distributed according to the particular opening-area ratio of the flow control valves 26*a* to 26.

As can be seen from their symbol representation in FIG. 1A, the pressure compensating valves 27*a* to 27*h* are each of a type not fully closing at a stroke end of the valve as operated in a direction to decrease in opening area. The opening-area reduction direction here is a leftward direction of FIG. 1A.

Figure 1B:
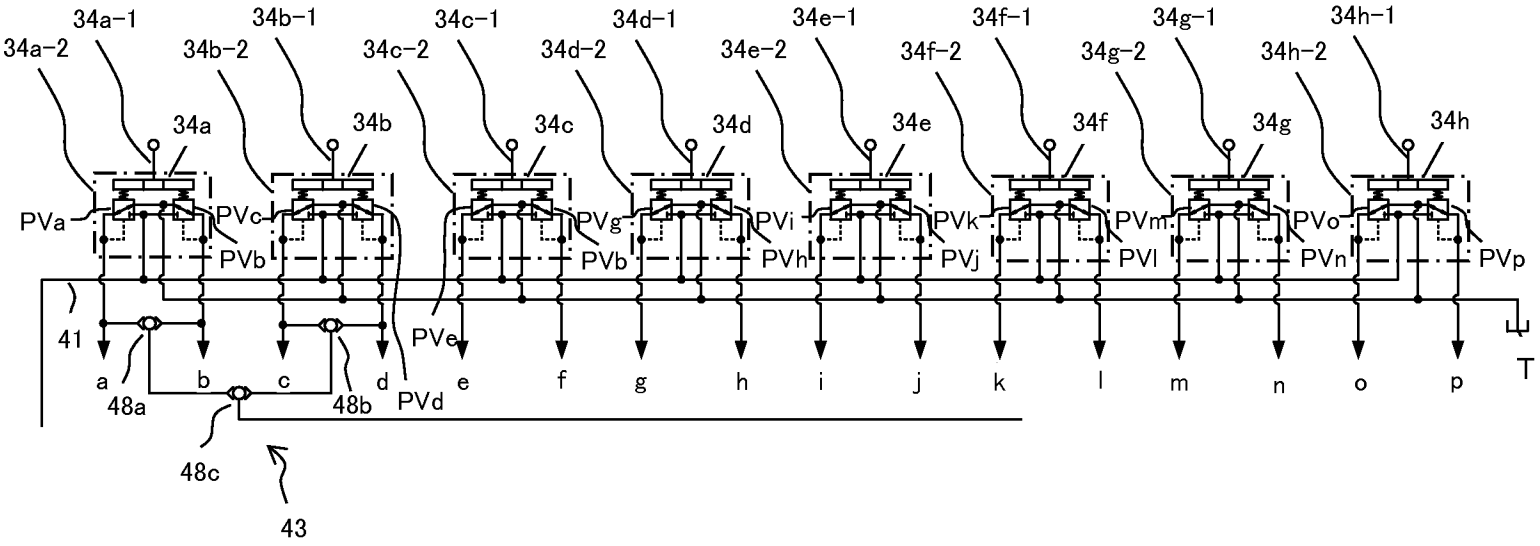
FIG. 1B is an enlarged view of operating devices and respective pilot circuits in the hydraulic driving system of the hydraulic excavator according to the first embodiment of the present invention.

The hydraulic driving system also includes: an engine speed detection valve 30 connected to a supply fluid line 3*a* of a pilot pump 3 and configured to output an absolute pressure according to a flow rate of the fluid delivered from the pilot pump 3; a pilot hydraulic fluid source 33 with a pilot relief valve 32 connected to a downstream end of the engine speed detection valve 30 and functioning to maintain a constant pressure inside a pilot hydraulic fluid line 31; and operating devices 34*a*, 34*b*, 34*c*, 34*d*, 34*e*, 34*f*, 34*g*, and 34*h*, which include, as shown in FIG. 1B, remote control valves 34*a*-2, 34*b*-2, 34*c*-2, 34*d*-2, 34*e*-2, 34*f*-2, 34*g*-2, and 34*h*-2 respectively that each use the pressure of the pilot hydraulic fluid source 33 as a main (primary) pilot pressure to generate an operating pilot pressure (a secondary pilot pressure) a, b, c, d, e, f, g, h, i, j, k, l, m, n, o, and p, and operate the flow control valves 26*a* to 26*h* with the operating pilot pressure.

The engine speed detection valve 30 includes a restriction element (fixed restrictor) 30*f* disposed in a fluid line connecting the supply fluid line 3*a* of the pilot pump 3 to the pilot hydraulic fluid line 31, a flow detection valve 30*a* connected in parallel to the restriction element 30*f*, and a differential-pressure reducing valve 30*b*. The flow detection valve 30*a* is connected at its inlet side to the supply fluid line 3*a* of the pilot pump 3, and at its outlet side to the pilot hydraulic fluid line 31. The flow detection valve 30*a* includes a variable restrictor 30*c* that increases an opening area of its own as the flow rate of the fluid passing through the restrictor 30*c* increases. The fluid that has been delivered from the pilot pump 3 flows through both of the restriction element 30*f* and the variable restrictor 30*c* of the flow detection valve 30*a*, and then flows into the pilot hydraulic fluid line 31. At this time, a differential pressure that increases with increases in the flow rate of the passing fluid occurs in the restriction element 30*f* and in the variable restrictor 30*c* of the flow detection valve 30*a*, and the differential-pressure reducing valve 30*b* outputs the particular differential pressure as an absolute pressure Pa. Since the flow rate of the delivered fluid from the pilot pump 3 changes with the engine speed, detection of both the differential pressure across the restriction element 30*f* and the differential difference across the variable restrictor 30*c* allows detection of the fluid delivery rate of the pilot pump 3, and hence, detection of the engine speed. Additionally the fixed restrictor 30*c* is constructed so that as the flow rate of the passing fluid increases (i.e., as the differential pressure increases), the restrictor increases an opening area of its own, thus rendering an increase rate of the differential pressure more gentle as the flow rate of the passing fluid increases.

The main pump 2 is a variable-displacement type of hydraulic pump, including a pump control unit 35 to control a tilting angle (capacity) of the pump. The pump control unit 35 includes a pump torque controller 35A and a load-sensing (LS) controller 35B.

The pump torque controller 35A includes a torque control tilting actuator 35*a*, and the torque control tilting actuator 35*a* drives a swash plate (capacity varying member) 2*s* of the main pump 2 to reduce the tilting angle (capacity) of the main pump 2 with increases in the fluid delivery pressure of the main pump 2 and limit an input torque of the main pump 2 under a previously set maximum torque value. This control limits horsepower consumption within the main pump 2 and prevents the engine 1 from coming to a stop, or engine stall, due to overload.

The LS controller 35B includes an LS control valve 35*b* and an LS control tilting actuator 35*c*.

The LS control valve 35*b* includes opposed pressure-receiving portions 35*d* and 35*e*. The absolute pressure Pa that the differential-pressure reducing valve 30*b* of the engine speed detection valve 30 has generated is guided as a load-sensing control target differential pressure, or a target LS differential pressure, into the pressure-receiving portion 35*d* via a fluid line 40. The absolute pressure PLS that the differential-pressure reducing valve 24 has generated (i.e., the differential pressure PLS between the fluid delivery pressure Pd of the main pump 2 and the maximum load pressure PLmax) is guided as a feedback differential pressure into the pressure-receiving portion 35*e*. As the absolute pressure PLS increases above the absolute pressure Pa (i.e., PLS>Pa), the LS control valve 35*b* guides the pressure of the pilot hydraulic fluid source 33 to the LS control tilting actuator 35*c*, and as the absolute pressure PLS decreases below the absolute pressure Pa (i.e., PLS<Pa), the LS control valve 35*b* makes the LS control tilting actuator 35*c* communicate with the tank T. Upon receiving the pressure guided from the pilot hydraulic fluid source 33, the LS control tilting actuator 35*c* drives the swash plate 2*s* of the main pump 2 to reduce the tilting angle of the main pump 2, and upon being made to communicate with the tank T, the LS control tilting actuator 35*c* drives the swash plate 2*s* of the main pump 2 to increase the tilting angle of the main pump 2. The tilting angle (capacity) of the main pump 2 is thus controlled so that the fluid delivery pressure Pd of the main pump 2 is higher than the maximum load pressure PLmax by the absolute pressure Pa, the target differential pressure.

The absolute pressure Pa here is a value that changes according to the particular engine speed. Use of the absolute pressure Pa as the target differential pressure for load-sensing control, therefore, allows control of an actuator speed appropriate for the engine speed, by setting the target compensation differential pressure of the pressure compensating valves 27*a* to 27*h* as per the absolute pressure PLS of the differential pressure between the fluid delivery pressure Pd of the main pump 2 and the maximum load pressure PLmax.

The spring 25*a* of the unloading valve 25 is set to have a pressure slightly higher than the absolute pressure Pa (target differential pressure for load-sensing control) that the differential-pressure reducing valve 30*b* of the engine speed detection valve 30 has generated at a rated maximum engine speed.

FIG. 1B is an enlarged view of the operating devices 34*a*, 34*b*, 34*c*, 34*d*, 34*e*, 34*f*, 34*g*, and 34*h*, and the respective pilot circuits.

The operating device 34*a* includes a control lever 34*a*-1 and a remote control valve 34*a*-2, and the remote control valve 34*a*-2 includes a pair of pressure reducing valves, PVa and PVb. Manipulating the control lever 34*a*-1 in a rightward direction of FIG. 1B activates the pressure reducing valve PVa of the remote control valve 34*a*-2 to generate an operating pilot pressure "a" of a magnitude commensurate with the amount of operation of the control lever 34*a*-1. Manipulating the control lever 34*a*-1 in a leftward direction of FIG. 1B activates the pressure reducing valve PVb of the remote control valve 34*a*-2 to generate an operating pilot pressure "b" of a magnitude commensurate with the amount of operation of the control lever 34*a*-1.

The operating devices 34*b* to 34*h* are also constructed similarly to and operate as with the operating device 34*a*. That is to say, the operating devices 34*b* to 34*h* include control levers 34*b*-1, 34*c*-1, 34*d*-1, 34*e*-1, 34*f*-1, 34*g*-1, and 34*h*-1, respectively, and remote control valves 34*b*-2, 34*c*-2, 34*d*-2, 34*e*-2, 34*f*-2, 34*g*-2, and 34*h*-2, respectively. Manipulating the control levers 34*b*-1, 34*c*-1, 34*d*-1, 34*e*-1, 34*f*-1, 34*g*-1, and 34*h*-1 in a rightward direction of FIG. 1B activates pressure reducing valves PVc, PVe, PVg, PVi, PVk, PVm, and PVo of the remote control valves 34*b*-2, 34*c*-2, 34*d*-2, 34*e*-2, 34*f*-2, 34*g*-2, and 34*h*-2 respectively to generate operating pilot pressures "c", "e", "g", "i", "k", "m", and "o" of a magnitude commensurate with the amount of operation of the control lever 34*b*-1, 34*c*-1, 34*d*-1, 34*e*-1, 34*f*-1, 34*g*-1, or 34*h*-1. Manipulating the control levers 34*b*-1, 34*c*-1, 34*d*-1, 34*e*-1, 34*f*-1, 34*g*-1, and 34*h*-1 in a leftward direction of FIG. 1B activates pressure reducing valves PVd, PVf, PVh, PVj, PVl, PVn, and PVp of the remote control valves 34*b*-2, 34*c*-2, 34*d*-2, 34*e*-2, 34*f*-2, 34*g*-2, and 34*h*-2 respectively to generate operating pilot pressures "d", "f", "h", "j", "l", "n", and "p" of a magnitude commensurate with the amount of operation of the control lever 34*b*-1, 34*c*-1, 34*d*-1, 34*e*-1, 34*f*-1, 34*g*-1, or 34*h*-1.

Characteristic Elements

Next, constituent elements characterizing the hydraulic driving system according to the present embodiment are described below.

The hydraulic driving system according to the present embodiment includes control valves 100*f*, 100*g*, and 100*h*, as part of the elements characterizing the system. The control valve 100*f* is disposed in a parallel fluid line 41*f* that is a fluid line portion lying at an upstream side of the pressure compensating valve 27*f* for the boom. The control valve 100*g* is disposed in a parallel fluid line 41*g* that is a fluid line portion lying at an upstream side of the pressure compensating valve 27*g* for the arm. The control valve 100*h* is disposed in a parallel fluid line 41*h* that is a fluid line portion lying at an upstream side of the pressure compensating valve 27*h* for the bucket. The control valves 100*f*, 100*g*, and 100*h* reduce flow passage areas of the parallel fluid lines 41*f*, 41*g*, and 41*h* when the operating devices 34*a* and 34*b* for traveling are operated.

The control valves 100*f*, 100*g*, and 100*h* each have a fully open communicating position in which the valve fully opens to communicate, and a restricting position in which the valve reduces an opening area. When no operations are being carried out upon the operating devices 34*a* and 34*b* for traveling, the control valves 100*f*, 100*g*, and 100*h* are in their fully open communicating positions shown at left positions of the valves in FIG. 1A. When the operating devices 34*a* and 34*b* for traveling are operated, the control valves are switched to respective restricting positions shown as right positions of the valves in FIG. 1A. When each switched to the restricting position, the control valves 100*f*, 100*g*, and 100*h* reduce the flow passage areas of the parallel fluid lines 41*f*, 41*g*, and 41*h* which are the fluid line portions lying at the upstream sides of the pressure compensating valves 27*f*, 27*g*, and 27*h*.

The hydraulic driving system according to the present embodiment further includes an operations detector 43 that detects any operations on the operating devices 34*a* and 34*b* for traveling. As shown in FIG. 1B, the operations detector 43 includes shuttle valves 48*a*, 48*b*, and 48*c* that detect the operating pilot pressures generated by the operating devices 34*a* and 34*b* for traveling, and output the detected operating pilot pressures as hydraulic signals. The control valves 100*f*, 100*g*, and 100*h* are hydraulic control valves switched by the hydraulic signals denoting the magnitude of the operating pilot pressures for traveling, and the hydraulic signals are guided to pressure-receiving portions 101*f*, 101*g*, and 101*h* of the control valves 100*f*, 100*g*, and 100*h*. When no operations are being performed upon the operating devices 34*a* and 34*b* for traveling and the operating pilot pressures for traveling are not being generated, the control valves 100*f*, 100*g*, and 100*h* are in the respective fully open communicating positions shown as the left positions in FIG. 1A. When the operating devices 34*a* and 34*b* for traveling are operated and the operating pilot pressures for traveling are guided as the hydraulic signals to the pressure-receiving portions 101*f*, 101*g*, and 101*h* of the control valves 100*f*, 100*g*, and 100*h*, each of the control valves 100*f*, 100*g*, and 100*h* is switched to the restricting position shown as the right position in FIG. 1A.

Figure 3A:
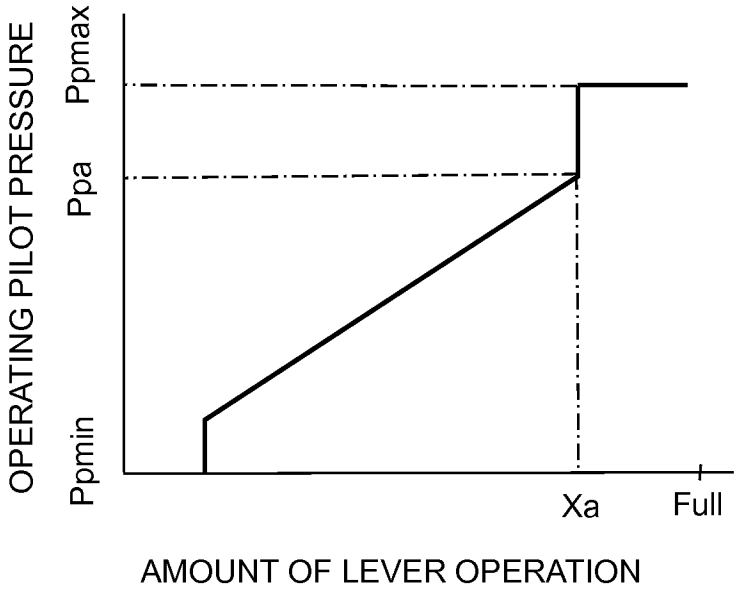
FIG. 3A is a diagram representing a relationship between the amount of lever operation of an operating device for traveling, and an operating pilot pressure (hydraulic signal).
Figure 3B:
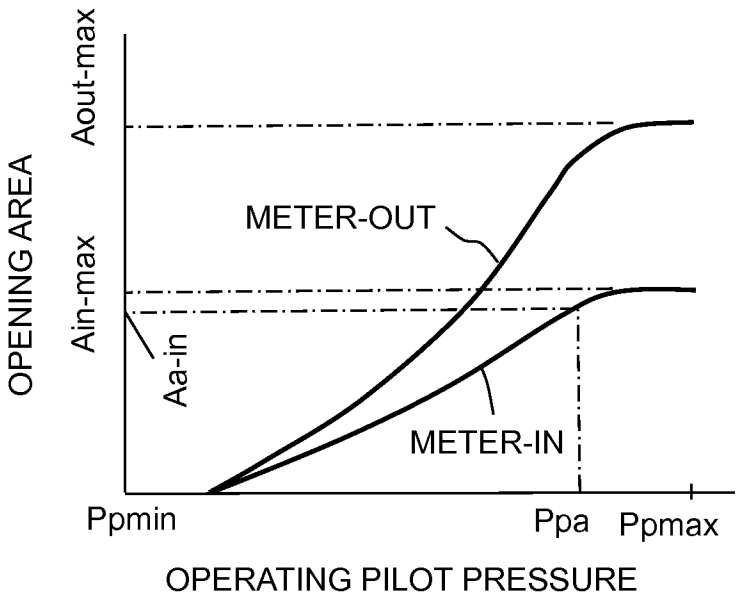
FIG. 3B is a diagram representing a relationship between the operating pilot pressure for traveling, and meter-in and meter-out opening areas of a flow control valve for traveling.
Figure 3C:
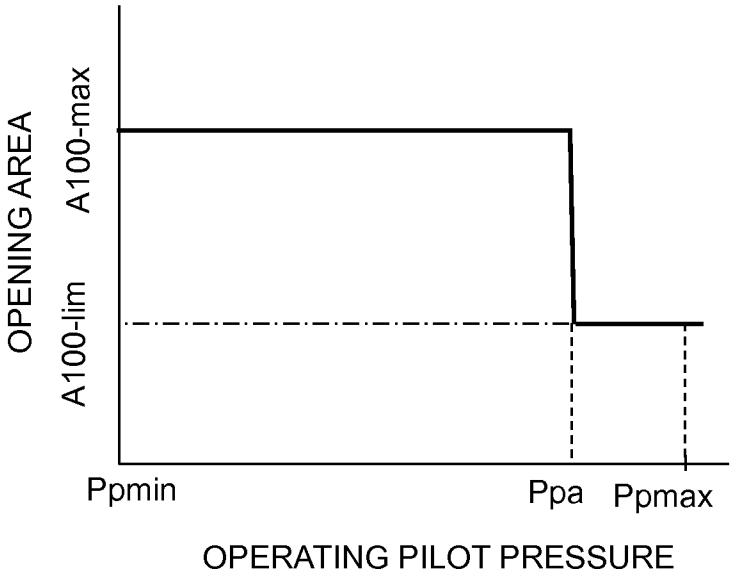
FIG. 3C is a diagram representing a relationship between the operating pilot pressure for traveling, and an opening area of a control valve.

FIG. 3A is a diagram representing a relationship between the amount of lever operation of the operating device 34*a* or 34*b* and the operating pilot pressure (hydraulic signal) commensurate with the amount of operation of the lever; FIG. 3B is a diagram representing a relationship between the operating pilot pressure and meter-in and meter-out opening areas of the flow control valve 26*a* or 26*b* for traveling; and FIG. 3C is a diagram representing a relationship between the operating pilot pressure and the opening area of the control valve 100*f*, 100*g*, or 100*h*. As the amount of lever operation increases, the operating pilot pressure increases from a minimum pressure Ppmin to a maximum pressure Ppmax as shown in FIG. 3A, and as the operating pilot pressure increases, the meter-in and meter-out opening areas of the flow control valve 26*a* or 26*b* for traveling increase from zero to a maximum area Amax as shown in FIG. 3B.

Reference symbol Xa in FIG. 3A denotes the amount of control lever operation of the control valve 100*f*, 100*g*, or 100*h*. Reference symbols Ppa and Aa-in in FIGS. 3A to 3C denote the operating pilot pressure and the meter-in opening area, respectively, with respect to the amount of control lever operation, Xa. Reference symbol A100-max in FIG. 3C denotes the opening area of the control valve 100*f*, 100*g*, or 100*h* as set to the communicating position. Reference symbol A100-lim denotes the opening area of the control valve 100*f*, 100*g*, or 100*h* as set to the restricting position. When no operations are being carried out upon the control lever 34*a*-1 or 34*b*-1 of the operating device 34*a* or 34*b* for traveling, the operating pilot pressure for traveling is not generated, so the control valve 100*f*, 100*g*, or 100*h* is in the communicating position shown as the left position in FIG. 1A. At this time, the opening area of the control valve 100*f*, 100*g*, or 100*h* is A100-max. When the control lever 34*a*-1 or 34*b*-1 of the operating device 34*a* or 34*b* for traveling is operated, the operating pilot pressure for traveling is generated and the meter-in opening area of the flow control valve 26*a* or 26*b* for traveling increases, which in turn increases the flow rate of the hydraulic fluid supplied to the track motor 5 or 6. However, when the amount of control lever operation is Xa or less and the operating pilot pressure for traveling is Ppa or less, the control valve 100*f*, 100*g*, or 100*h* does not switch and is held in the communicating position shown as the left position in FIG. 1A. Accordingly, the control valve 100*f*, 100*g*, or 100*h* maintains the opening area of A100-max. When the amount of control lever operation exceeds Xa and the operating pilot pressure increases above Ppa, the control valve 100*f*, 100*g*, or 100*h* switches to the restricting position shown as the right position in FIG. 1A and the opening area of the control valve 100*f*, 100*g*, or 100*h* decreases to A100-lim. The amount of control lever operation, Xa, of the control valve 100*f*, 100*g*, or 100*h* here is set to have a value close to a full stroke denoted as 'Full', and the operating pilot pressure Ppa and meter-in opening area Aa-in corresponding to that set amount of control lever operation, Xa, take values close to the maximum pressure Ppmax and the maximum opening area Ain-max, respectively. The amount of control lever operation, Xa, preferably takes a value ranging from, for example, nearly 70% to 95% of the full stroke 'Full', and further preferably takes a value ranging from, for example, nearly 80% to 90% of the full stroke 'Full'. In addition, if the operating pilot pressure has a characteristic to increase from Ppa to Ppmax stepwise as shown in FIG. 3A, the operating pilot pressure is preferably adjusted to the amount of lever operation that increases the operating pilot pressure stepwise, or to an immediately previous amount of lever operation.

During slope climbing, when at least one of the boom cylinder 10, the arm cylinder 11, and the bucket cylinder 12 is driven by combined operations control, the difference in load pressure between the track motor 5 or 6 and one of the boom cylinder 10, the arm cylinder 11, and the bucket cylinder 12, becomes particularly significant and the pressure compensating valve of the actuator with the lower load pressure, namely one of the boom cylinder 10, the arm cylinder 11, and the bucket cylinder 12, operates nearly to the stroke end in the direction that the opening area decreases. If saturation occurs during the combined operations control where the difference in load pressure tends to become particularly significant, a large portion of the fluid delivered from the main pump is likely to be absorbed by the actuator lower in load pressure, with the result that the track motor 5 or 6 is likely to stop operating. The actuator that undergoes the higher load pressure during the combined operations control likely to generate the particularly significant difference in load pressure may be hereinafter referred to as the specific actuator. In addition to the track motors, examples of the specific actuator include, as described later herein, a standby actuator provided on an attachment such as a crusher.

Operation of the Basic Elements

First, operation of the basic elements constituting the hydraulic driving system according to the present embodiment is described below.

When all Control Levers are in their Neutral Positions

When the control levers 34*a*-1 to 34*h*-1 of all operating devices 34*a* to 34*h* are in their neutral positions, all flow control valves 26*a* to 26*h* are also in the respective neutral positions and the hydraulic fluid is not supplied to the actuators 5 to 12. Additionally, when all flow control valves 26*a* to 26*h* are in the neutral positions, the maximum load pressure PLmax detected by the shuttle valves 22*a* to 22*g* will be equal to the tank pressure.

The fluid that has been delivered from the main pump 2 is supplied to the supply fluid lines 2*a* and 4*a*, which increases the pressures in the supply fluid lines 2*a* and 4*a*. In the supply fluid line 4*a* is disposed the unloading valve 25, which, when the pressure in the supply fluid line 2*a* increases by at least the preset pressure of the spring 25*a* above the maximum load pressure PLmax (in the above case, the tank pressure), opens to return the hydraulic fluid within the supply fluid line 2*a* to the tank and limit an increase in the internal pressure of the supply fluid line 2*a*. This controls the fluid delivery pressure of the main pump 2 to the minimum pressure Pmin.

The differential pressure PLS between the fluid delivery pressure of the main pump 2 and the maximum load pressure PLmax is output as the absolute pressure from the differential-pressure reducing valve 24. The output pressure of the engine speed detection valve 30 and that of the differential-pressure reducing valve 24 are guided into the LS control valve 35*b* of the LS controller 35B within the main pump 2. When the fluid delivery pressure of the main pump 2 increases and the output pressure of the differential-pressure reducing valve 24 increases above that of the engine speed detection valve 30, the LS control valve 35*b* switches to a position shown as the right position in FIG. 1A, then the pressure from the pilot hydraulic fluid source 33 is guided into the LS control tilting actuator 35*c*, and the tilting angle of the main pump 2 is controlled to decrease. Since the main pump 2 includes a stopper (not shown) that regulates a minimum value of the tilting angle, however, the main pump 2 has its tilting angle held at the stopper-regulated minimum tilting angle "qmin", and delivers the fluid at a minimum flow rate Qmin.

When a Control Lever is Operated

When a driven member such as the control lever 34*f*-1 of the operating device 34*f* for the boom is operated, the flow control valve 26*f* for the boom switches, then the hydraulic fluid is supplied to the boom cylinder 10, and the boom cylinder 10 is driven.

The flow rate of the fluid through the flow control valve 26*f* is dictated by the opening area of the meter-in restrictor of the flow control valve 26*f* and a differential pressure detected across the meter-in restrictor. The differential pressure across the meter-in restrictor is controlled, by the pressure compensating valve 27, to equal the output pressure of the differential-pressure reducing valve 24. Accordingly the flow rate of the fluid through the flow control valve 26*f* (hence a driving speed of the boom cylinder 10) is controlled according to the particular amount of operation of the control lever.

Meanwhile, the load pressure upon the boom cylinder 10 is detected as a maximum load pressure by a corresponding one of the shuttle valves 22*a* to 22*g*, and then transmitted to the differential-pressure reducing valve 24 and the unloading valve 25.

When the load pressure of the boom cylinder 10 is guided into the unloading valve 25 as the maximum load pressure, the unloading valve 25 correspondingly raises a cracking pressure, or a pressure at which the unloading valve 25 begins to open, and then when the pressure in the supply fluid line 2*a* temporarily be higher by at least the preset pressure of the spring 25*a* than the maximum load pressure, the unloading valve 25 opens to return the hydraulic fluid within the supply fluid line 4*a* to the tank. Thus the pressure in the supply fluid lines 2*a* and 4*a* is controlled to be not higher, by the preset pressure set for the spring 25*a*, than the maximum load pressure PLmax.

Once the boom cylinder 10 has begun to operate, the pressure in the supply fluid lines 2*a* and 4*a* temporarily decreases. At this time, the output pressure of the differential-pressure reducing valve 24 also decreases since the difference in load pressure between the pressure of the supply fluid line 2*a* and the load pressure of the boom cylinder 10 is output as the output pressure of the differential-pressure reducing valve 24.

The output pressure of the engine speed detection valve 30 and that of the differential-pressure reducing valve 24 are introduced into the LS control valve 35*b* of the LS controller 35B of the main pump 2, and when the output pressure of the differential-pressure reducing valve 24 decreases below that of the engine speed detection valve 30, the LS control valve 35*b* switches to a position shown as the left position in FIG. 1A, and the LS control tilting actuator 35*c* is made to communicate with the tank T. The hydraulic fluid in the LS control tilting actuator 35*c* is then returned to the tank, the tilting angle of the main pump 2 is controlled to increase, and the flow rate of the fluid delivered from the main pump 2 also increases. This increase in the flow rate of the delivered fluid from the main pump 2 is continued until the output pressure of the differential-pressure reducing valve 24 has equaled that of the engine speed detection valve 30. Through the succession of machine actions, the fluid delivery pressure of the main pump 2 (i.e., the pressure in the supply fluid lines 2*a* and 4*a*) is controlled to increase by the output pressure of the engine speed detection valve 30 (i.e., the target differential pressure) above the maximum load pressure PLmax, and the fluid is supplied to the boom cylinder 10 at the flow rate demanded from the flow control valve 26*f* for the boom. This process is referred to as load-sensing control.

When at least two driven members, for example the control levers 34*f*-1 and 34*g*-1 of the operating device 34*f* for the boom and the operating device 34*g* for the arm are operated, the flow control valves 26*f* and 26*g* both switch, then the hydraulic fluid is supplied to the boom cylinder 10 and the arm cylinder 11, and the boom cylinder 10 and the arm cylinder 11 are driven.

Of the load pressures in the boom cylinder 10 and the arm cylinder 11, the higher pressure is detected as the maximum load pressure PLmax by the shuttle valves 22*a* to 22*g* and transmitted to the differential-pressure reducing valve 24 and the unloading valve 25.

The way the unloading valve 25 operates in this case when the maximum load pressure PLmax that the shuttle valves 22*a* to 22*g* have detected is guided to the unloading valve 25 is the same as developed when the boom cylinder 10 is driven independently. In other words, as the maximum load pressure PLmax increases, the cracking pressure of the unloading valve 25 also increases and the pressure in the supply fluid lines 2*a* and 4*a* is controlled to be not higher than the maximum load pressure PLmax by the preset pressure for the spring 25*a*.

The output pressure of the engine speed detection valve 30 and that of the differential-pressure reducing valve 24 are also introduced into the LS control valve 35*b* of the LS controller 35B of the main pump 2. In this case, as in the case with the independent driving of the boom cylinder 10, so-called load-sensing control is performed. That is to say, the fluid delivery pressure of the main pump 2 (i.e., the pressure in the supply fluid lines 2*a* and 4*a*) is controlled to be higher, by the output pressure of the engine speed detection valve 30 (i.e., the target differential pressure), than the maximum load pressure PLmax, and the fluid is supplied to the boom cylinder 10 and the arm cylinder 11 at the flow rates demanded from the flow control valves 26*f* and 26*g*.

The output pressure of the differential-pressure reducing valve 24 is introduced into the pressure compensating valves 27*a* to 27*h* as the target compensation differential pressure, and the pressure compensating valves 27*f* and 27*g* each control the differential pressure across the corresponding one of the flow control valves 26*f* and 26*g* respectively to equal the differential pressure between the fluid delivery pressure of the main pump 2 and the maximum load pressure PLmax. With this control, irrespective of the magnitude of the load pressures of the boom cylinder 10 and the arm cylinder 11, the hydraulic fluid can be supplied to the boom cylinder 10 and the arm cylinder 11 at a ratio commensurate with a meter-in restrictor opening area ratio between the flow control valves 26*f* and 26*g*.

At this time, if saturation occurs, in other words, if the flow rate of the fluid delivered from the main pump 2 does not satisfy the flow rate demands of the flow control valves 26*f* and 26*g*, the output pressure of the differential-pressure reducing valve 24 (i.e., the differential pressure between the fluid delivery pressure of the main pump 2 and the maximum load pressure PLmax) decreases according to a particular degree of the saturation. The decrease in the output pressure of the differential-pressure reducing valve 24 correspondingly reduces the target compensation differential pressures of the pressure compensating valves 27*a* to 27*h*, thus enabling the delivery flow rate of the hydraulic fluid from the main pump 2 to be redistributed to the ratio of the flow rates demanded from the flow control valves 26*f* and 26*g*.

The pressure compensating valves 27*a* to 27*h* are each constructed so that they do not fully close at the stroke end of the valve as operated in the direction that the opening area decreases. In addition to the above favorable effects, therefore, during the combined operations control where one of the boom cylinder 10 and the arm cylinder 11 is operated with the other being used, even if saturation occurs and the pressure compensating valve lower in load pressure operates through a long stroke in the direction that the opening area decreases, full closing of the pressure compensating valve lower in load pressure is prevented, which in turn prevents complete shutoff of the hydraulic fluid. Hence a slowdown and stop of the actuator with the lower load pressure can be prevented.

When the Engine Speed is Reduced

The operation described above applies when the engine 1 rotates at its maximum rated speed. On the other hand, when the engine speed is reduced, since the output pressure of the engine speed detection valve 30 correspondingly decreases, the LS control valve 35*b* of the LS controller 35B likewise decreases in target differential pressure. The pressure compensating valves 27*a* to 27*h* also experience a similar decrease in target compensation differential pressure after load-sensing control. Thus as the engine speed decreases, both the flow rate of the delivered fluid from the main pump 2 and the flow rates demanded from the flow control valves 26*a* to 26*h* decrease, which then enables the driving speeds of the actuators 5 to 12 to be appropriately maintained and fine (microscopic) operability/controllability at reduced engine speeds to be improved.

Operation of the Characteristic Elements

The following describes operation of the characteristic elements constituting the hydraulic driving system of the present embodiment.

When the control levers 34*a*-1 and 34*b*-1 of the operating devices 34*a* and 34*b* for traveling are operated, the flow control valves 26*a* and 26*b* both switch as in the combined operations control described above, and thereby the hydraulic fluid is supplied to the track motors 5 and 6. Additionally, the fluid delivery flow rate of the main pump 2 is controlled by load-sensing control, the fluid is supplied to the track motors 5 and 6 at the flow rates demanded from the flow control valves 26*a* and 26*b*, and the hydraulic excavator travels.

During traveling, when either the boom, the arm, or the bucket, for example the control lever 34*g*-1 of the operating device 34*g* for the arm is operated for a change in the posture of the front working implement, the flow control valve 26*g* switches, thereby the hydraulic fluid is also supplied to the arm cylinder 11 and the arm cylinder 11 is driven.

In a conventional system configuration with pressure compensating valves each of a type not fully closing at a stroke end of the valve as operated in a direction that an operating area decreases, during traveling control with a driven member, when another driven member (e.g., a boom, an arm, or a bucket) is operated, under the conditions that involve a high traveling load pressure particularly for climbing a slope, a pressure compensating valve of an actuator lower in load pressure than track motors, such as a boom cylinder, arm cylinder, or bucket cylinder, is open even after reaching the stroke end. A flow rate of a fluid delivered from a hydraulic pump may therefore be drawn into the actuator lower in load pressure, with the result that traveling may slow down and/or stop.

In contrast to the above conventional system configuration, in the present embodiment, when a full-stroke operation is being carried out upon the control lever 34*a*-1 or 34*b*-1 of the operating device 34*a* or 34*b* for traveling and the operating pilot pressure for traveling is being generated, the control valve 100*f*, 100*g*, or 100*h* switches to the restricting position shown as the right position in FIG. 1A, and thereby reduces the flow passage area of the parallel fluid line 41*f*, 41*g*, or 41*h*, that is, the fluid line portion at the upstream side of the pressure compensating valve 27*f*, 27*g*, or 27*h*. The result is that when either the boom, the arm, or the bucket, more specifically, for example the control lever 34*g*-1 of the operating device 34*g* for the arm is operated under the conditions that involve a high traveling load pressure particularly for slope climbing, the flow rate of the fluid to pass through the flow control valve 26*g* is limited and the flow rate of the fluid supplied to the arm cylinder 11 is suppressed. This ensures a necessary supply of hydraulic fluid to the track motor 5 or 6, prevents a slowdown and stop of traveling, and provides appropriate combined-operations controllability.

On the other hand, the combined operations control for traveling along a level ground surface is usually conducted at low speeds and the load pressure upon the track motors 5 and 6 is usually not too high. Even during the low-speed combined operations control for traveling, when the control lever 34*a*-1 or 34*b*-1 of the operating device 34*a* or 34*b* for traveling is operated and the control valve 100*f*, 100*g*, or 100*h* switches to the restricting position, the flow rate of the fluid supplied to the boom cylinder 10, the arm cylinder 11, or the bucket cylinder 12 might be suppressed despite a low possibility that a large portion of the fluid delivered from the main pump 2 would be absorbed by the actuator having the lower load pressure. Operation of the front working implement 302 might consequently slow down to reduce working efficiency.

In the present embodiment, as described above, the amount of control lever operation, Xa, of the control valve 100*f*, 100*g*, or 100*h* is set to be a value close to 'Full', the maximum achievable operating stroke of the control lever. During the low-speed combined operations control for traveling on a level ground surface, therefore, when the control lever 34*a*-1 or 34*b*-1 of the operating device 34*a* or 34*b* for traveling is operated, the control valve 100*f*, 100*g*, or 100*h* does not switch to the restricting position. For this reason, the flow rate of the hydraulic fluid supplied to the boom cylinder 10, the arm cylinder 11, or the bucket cylinder 12 will not be suppressed. This will slow down the operation of the front working implement 302 and hence prevent working efficiency from decreasing.

Advantageous Effects

As set forth above, in the present embodiment, even if saturation occurs during the combined operations control likely to generate a significant difference in load pressure between any two actuators, full closing of the pressure compensating valve lower in load pressure is prevented, which in turn prevents a slowdown and stop of the actuator lower in load pressure. In addition, during the combined operations control for traveling that includes the driving of the track motor 5 or 6 as the specific actuator, a flow of the hydraulic fluid into the boom cylinder 10, the arm cylinder 11, or the bucket cylinder 12 is suppressed, the necessary amount of hydraulic fluid is supplied to the track motor 5 or 6, and a slowdown and stop of traveling is prevented. The combined operations controllability for traveling can therefore be enhanced.

Furthermore, since the amount of control lever operation, Xa, of the control valve 100*f*, 100*g*, or 100*h* is set to be a value close to 'Full', the maximum achievable operating stroke of the control lever, the operation of the front working implement 302 is prevented from slowing down during the low-speed combined operations control for traveling on a level ground surface. As a result, working efficiency can be prevented from decreasing.

Moreover, the control valves 100*f*, 100*g*, and 100*h* are arranged in the parallel fluid lines 41*f*, 41*g*, and 41*h*. Thus, when the control lever 34*a*-1 or 34*b*-1 of the operating device 34*a* or 34*b* for traveling is operated, the flow rate of the hydraulic fluid supplied only to the actuator corresponding to the parallel fluid line 41*f*, 41*g*, or 41*h* (i.e., the boom cylinder 10, the arm cylinder 11, or the bucket cylinder 12) will be suppressed and the flow rates of the hydraulic fluid supplied to the other actuators will not be suppressed. During the combined operations control for driving the track motor 5 or 6 concurrently with any other actuator, reduction in operability/controllability due to a decrease in a speed of the other actuator can be prevented.

Second Embodiment

Figure 4:
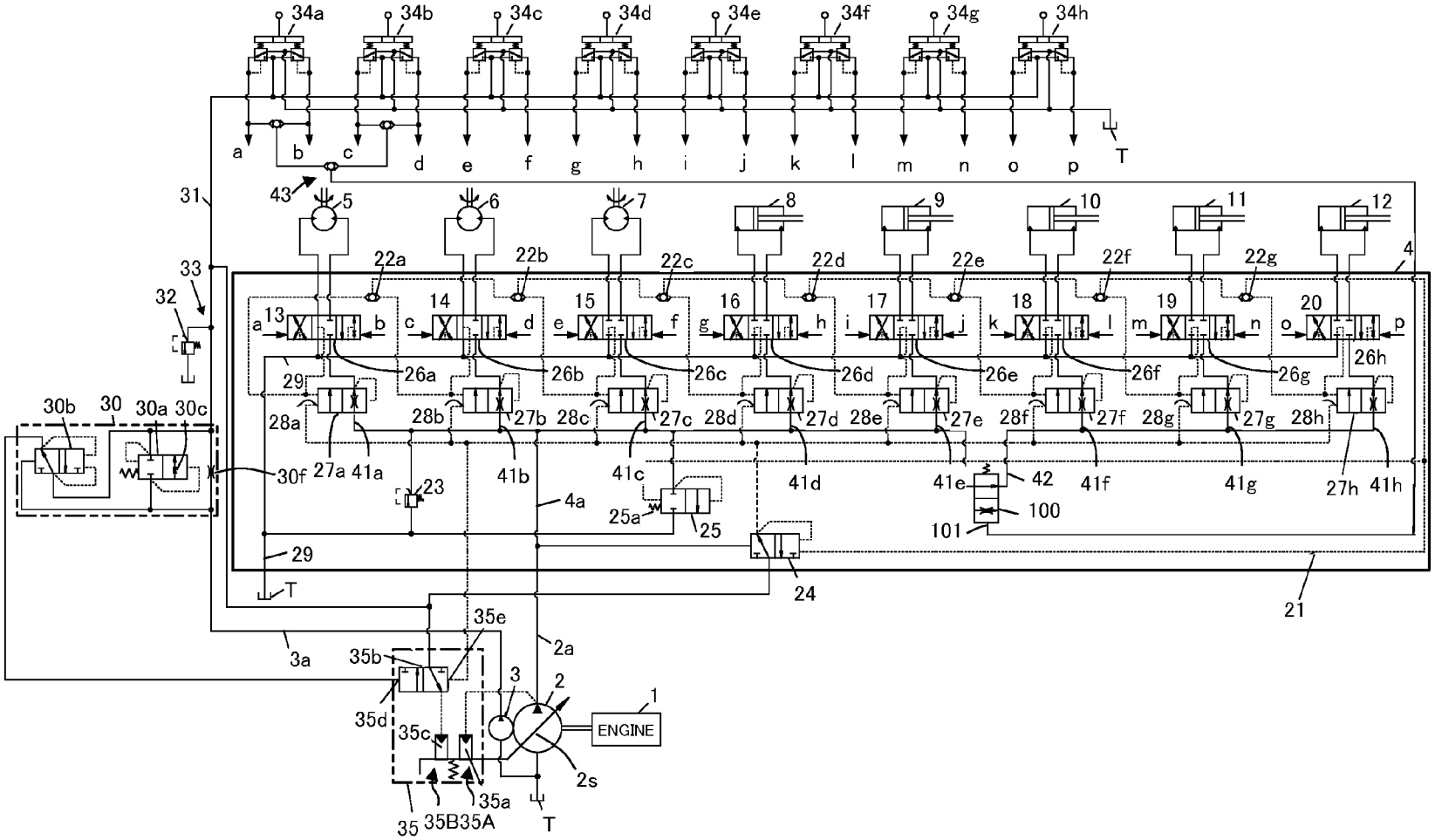
FIG. 4 is a diagram showing a hydraulic driving system of a hydraulic excavator according to a second embodiment of the present invention.

A hydraulic driving system according to a second embodiment of the present invention is shown in FIG. 4. Those members in FIG. 4 that are equivalent to the elements shown in FIG. 1 are each assigned the same reference number as used in FIG. 1, and overlapped description of the equivalent members is omitted herein. The present embodiment differs from the first embodiment in the configuration of the control valves arranged in the fluid line portions lying at the upstream sides of the pressure compensating valves 27*f*, 27*g*, and 27*h* for the boom, the arm, and the bucket, respectively.

More specifically, whereas the first embodiment shown in FIG. 1 includes the control valves 100*f*, 100*g*, and 100*h* arranged in the parallel fluid lines 41*f*, 41*g*, and 41*h* respectively with the pressure compensating valves 27*f*, 27*g*, and 27*h* arranged therein for the boom, the arm, and the bucket, respectively, the second embodiment includes one control valve, 100, in a fluid line portion of the supply fluid line 4*a* connected to the supply fluid line 2*a* of the main pump 2. The fluid line portion here is a fluid line portion 42 lying upstream relative to the most upstream branching position of the parallel fluid lines 41*f*, 41*g*, and 41*h* with the pressure compensating valves 27*f*, 27*g*, and 27*h* arranged therein for the boom, the arm, and the bucket, respectively.

The control valve 100, as with the control valves 100*f*, 100*g*, and 100*h*, has two positions, namely a fully open communicating position in which the valve fully opens to communicate, and a restricting position in which the valve reduces an opening area. When no operations are being carried out upon the operating devices 34*a* and 34*b* for traveling, the control valve 100 is in the fully open communicating position shown as an left position of the valve in FIG. 4, and when the operating devices 34*a* and 34*b* for traveling are operated, a hydraulic signal denoting a magnitude of an operating pilot pressure for traveling is guided into a pressure receiving portion 101 and the control valve is switched to the restricting position shown as a right position of the valve in FIG. 4. When the control valve 100 is switched to the restricting position, the parallel fluid line 42 is reduced in flow passage area and the flow control valves 26*f*, 26*g*, and 26*h* are limited in the flow rate of the fluid passing therethrough.

In the present embodiment of the above configuration, the operating pilot pressure for traveling is also generated when the operating device 34*a* or 34*b* for traveling is operated through a full stroke. The control valve 100 then switches to the restricting position shown as the lower position in FIG. 4, thereby limits the flow rate of the fluid passing through the flow control valve 26*f*, 26*g*, or 26*h*, and suppresses the flow rate of the fluid supplied to the arm cylinder 11. This ensures a necessary supply of hydraulic fluid to the track motor 5 or 6, prevents a stop of traveling, and provides appropriate combined-operations controllability.

As set forth above, substantially the same advantageous effects as those of the first embodiment can also be obtained in the second embodiment.

In the present embodiment, since the flow rates of the hydraulic fluid supplied to a plurality of actuators are also suppressed with one control valve 100, the advantageous effects described above can be obtained, thus the number of constituent parts needed can be reduced, and the effects can be obtained less expensively.

Third Embodiment

Figure 5:
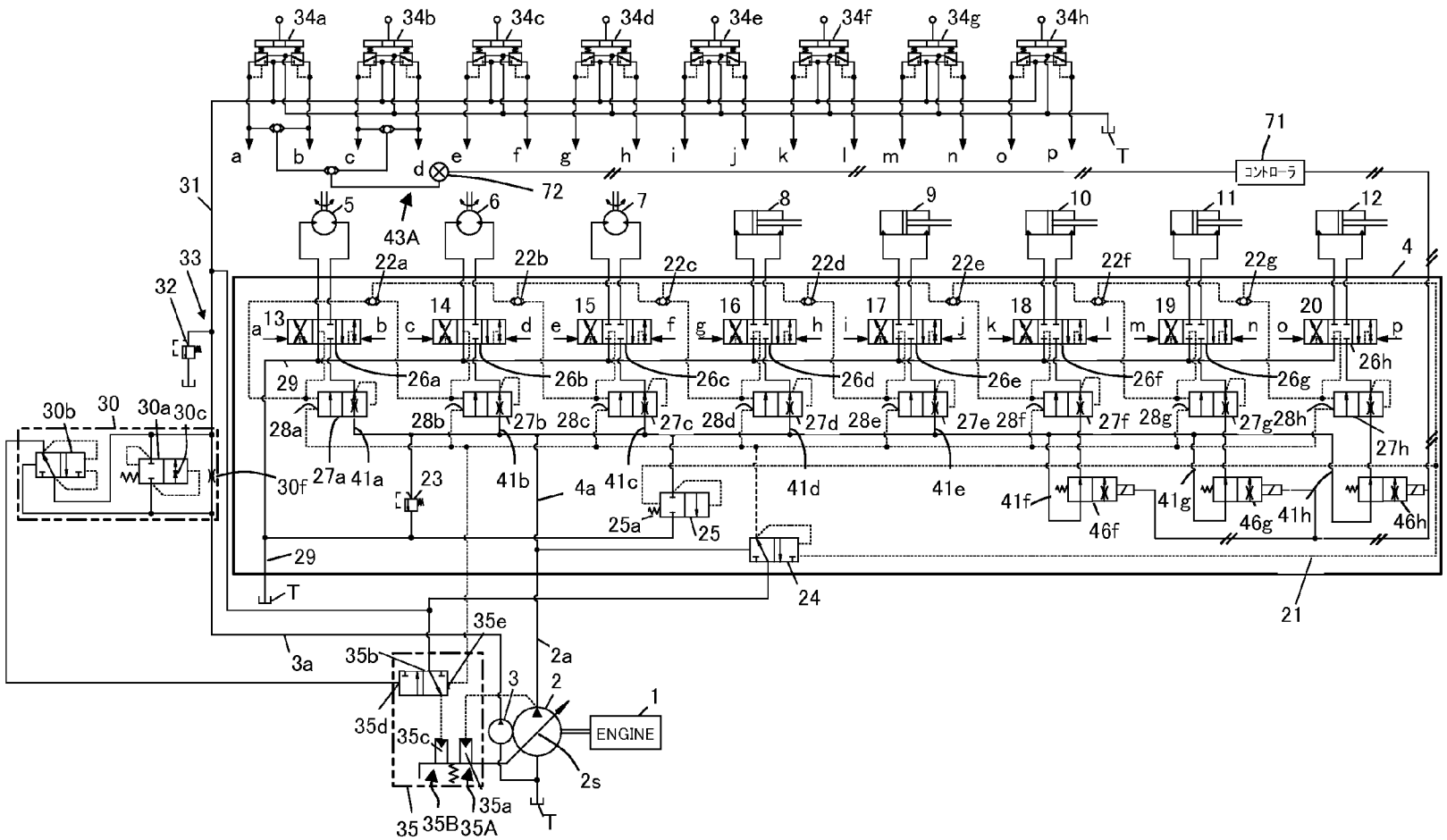
FIG. 5 is a diagram showing a hydraulic driving system of a hydraulic excavator according to a third embodiment of the present invention.

A hydraulic driving system according to a third embodiment of the present invention is shown in FIG. 5. Those members in FIG. 5 that are equivalent to the elements shown in FIG. 1 are each assigned the same reference number as used in FIG. 1, and overlapped description of the equivalent members is omitted herein. The present embodiment differs from the first embodiment in a switching scheme of the control valves arranged in the fluid line portions lying at the upstream sides of the pressure compensating valves.

More specifically, the hydraulic driving system in the third embodiment includes solenoid-operated control valves 46*f*, 46*g*, and 46*h* instead of the hydraulic control valves 100*f*, 100*g*, and 100*h* in the first embodiment. The hydraulic driving system also includes a controller 71. The hydraulic driving system further includes an operations detector 43A having, in addition to the shuttle valves 48*a*, 48*b*, and 48*c* shown in FIG. 1B, a pressure sensor 72 that detects an operating pilot pressure generated by a remote control valve of at least one of the operating devices 34*a* and 34*b* for traveling and outputs an appropriate electrical signal according to the operating pilot pressure. The electrical signal from the pressure sensor 72 is input to the controller 71, which then calculates the operating pilot pressure from the electrical signal and then if the operating pilot pressure exceeds Ppa (see FIG. 3A), outputs a driving signal to the solenoids of the solenoid-operated control valves 46*f*, 46*g*, and 46*h*.

When the operating devices 34*a* and 34*b* for traveling are not operated and the driving signal is not output from the controller 71, the solenoid-operated control valves 46*f*, 46*g*, and 46*h* are in their communicating positions shown as left positions of the valves in FIG. 5. When the operating devices 34*a* and 34*b* for traveling are operated and the driving signal is output from the controller 71, the solenoid-operated control valves are in their restricting positions shown as right positions of the valves in FIG. 5. When each switched to the restricting position, the solenoid-operated control valves 46*f*, 46*g*, and 46*h* reduce the flow passage areas of the parallel fluid lines 41*f*, 41*g*, and 41*h* and limit the flow rates of the fluid passing through the flow control valves 26*f*, 26*g*, and 26*h*.

Hence, substantially the same advantageous effects as those of the first embodiment can also be obtained in the third embodiment.

The present embodiment employs solenoid-operated control valves as a substitute for the control valves 100*f*, 100*g*, and 100*h* in the first embodiment. However, if a further solenoid-operated control valve is employed instead by the control valve 100 in FIG. 4 and substantially the same pressure sensor and controller as those employed in the present embodiment are disposed, the particular solenoid-operated control valve can be switched using an electrical signal transmitted from the controller.

Fourth Embodiment

Figure 6:
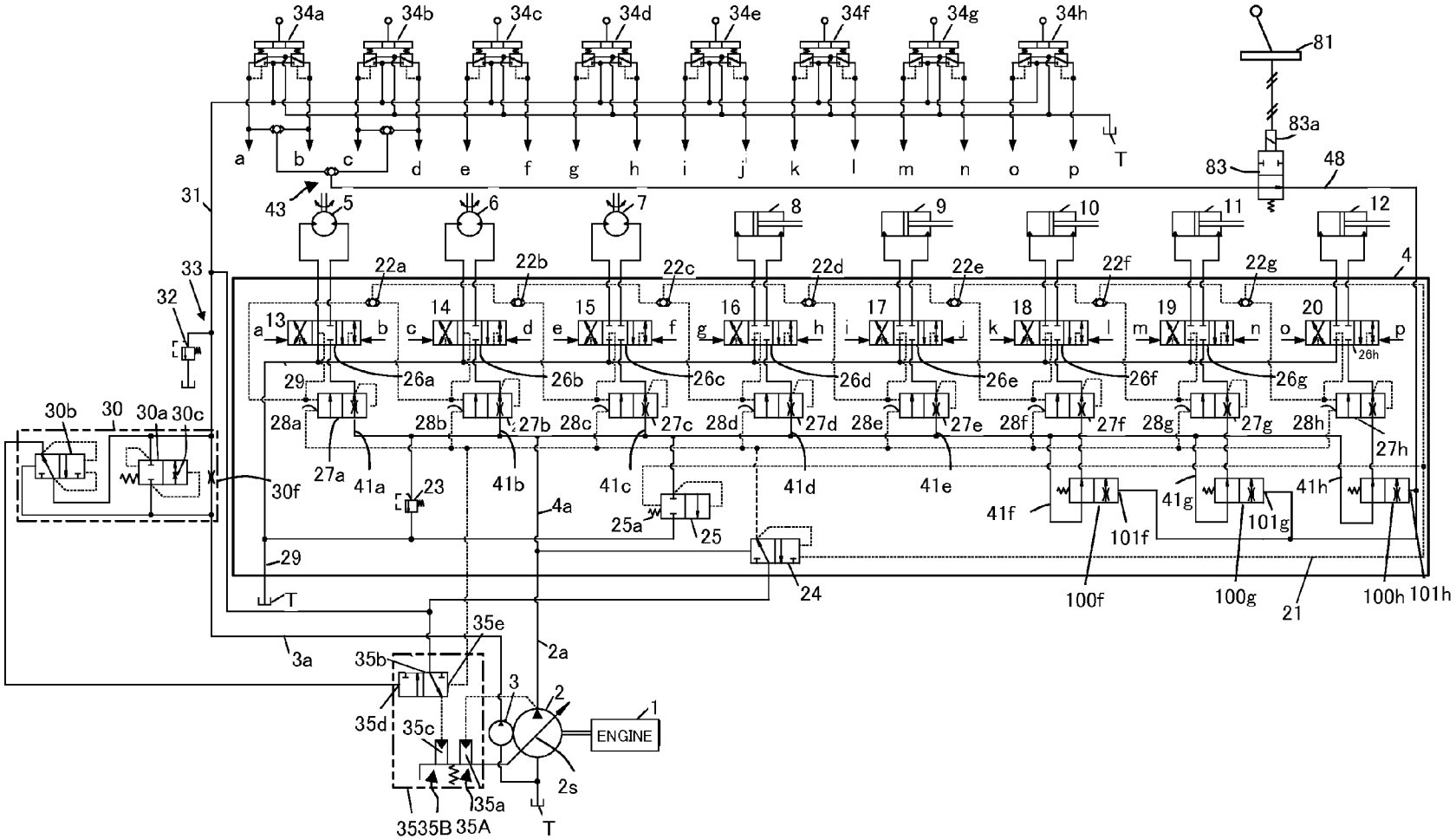
FIG. 6 is a diagram showing a hydraulic driving system of a hydraulic excavator according to a fourth embodiment of the present invention.

A hydraulic driving system according to a fourth embodiment of the present invention is shown in FIG. 6. Those members in FIG. 6 that are equivalent to the elements shown in FIG. 1 are each assigned the same reference number as used in FIG. 1, and overlapped description of the equivalent members is omitted herein. The present embodiment differs from the first embodiment in a configuration of the elements guiding a traveling pilot pressure to the control valves 100*f*, 100*g*, and 100*h*.

More specifically, the hydraulic driving system in the fourth embodiment additionally includes a manual selector 81 adapted to be switched between its first position and its second position. The manual selector 81 is, for example, a switch that will output an appropriate electrical signal according to the switching position selected. The present embodiment further includes a solenoid-operated control valve 83 disposed in a fluid line 48 to guide the hydraulic signal detected by the operations detector 43 beforehand to the pressure receiving portions 101*f*, 101*g*, and 101*h* of the control valves 100*f*, 100*g*, and 100*h*. The solenoid-operated control valve 83 operates in accordance with the electrical signal output from the manual selector (manual switch) 81.

When the manual selector 81 is in the first position and the electrical signal is not output, the solenoid-operated control valve 83 is in a first position shown as a lower position of the valve in FIG. 6. When in the first position, the solenoid-operated control valve 83 enables the hydraulic signal, detected by the operations detector 43, to be guided to the pressure receiving portions 101*f*, 101*g*, and 101*h* of the control valves 100*f*, 100*g*, and 100*h*. When the manual selector 81 is switched to the second position and the electrical signal is output to the solenoid 83*a* of the solenoid-operated control valve 83, the solenoid-operated control valve 83 switches over to a second position shown as an upper position of the valve in FIG. 6, and thereby prevents the hydraulic signal, detected by the operations detector 43, from being guided to the pressure receiving portions 101*f*, 101*g*, and 101*h* of the control valves 100*f*, 100*g*, and 100*h*.

Thus when the manual selector 81 is in the first position, the control valves 100*f*, 100*g*, and 100*h* activate the respective functions to reduce the flow passage areas of the parallel fluid lines 41*f*, 41*g*, and 41*h* in response to the operation of specific operating devices 34*a* and 34*b* for traveling. As in the above mentioned embodiments, therefore, supply of the hydraulic fluid to the boom cylinder 10, the arm cylinder 11, and the bucket cylinder 12 can be suppressed via the control valves 100*f*, 100*g*, and 100*h* during the combined operations control for traveling. When the manual selector 81 is switched to the second position, the control valves 100*f*, 100*g*, and 100*h* deactivate the respective functions of reducing the flow passage areas of the parallel fluid lines 41*f*, 41*g*, and 41*h* in response to the operation of the specific operating devices 34*a* and 34*b* for traveling. Even during the combined operations control for traveling, therefore, the suppression of the supply of the hydraulic fluid to the boom cylinder 10, the arm cylinder 11, and the bucket cylinder 12 is deactivated, which then enables substantially the same operation as achievable in conventional system configurations.

In the present embodiment having the above configuration, an operator can freely select whether to use a specific function of the present invention according to his or her needs or preference.

Fifth Embodiment

Figure 7:
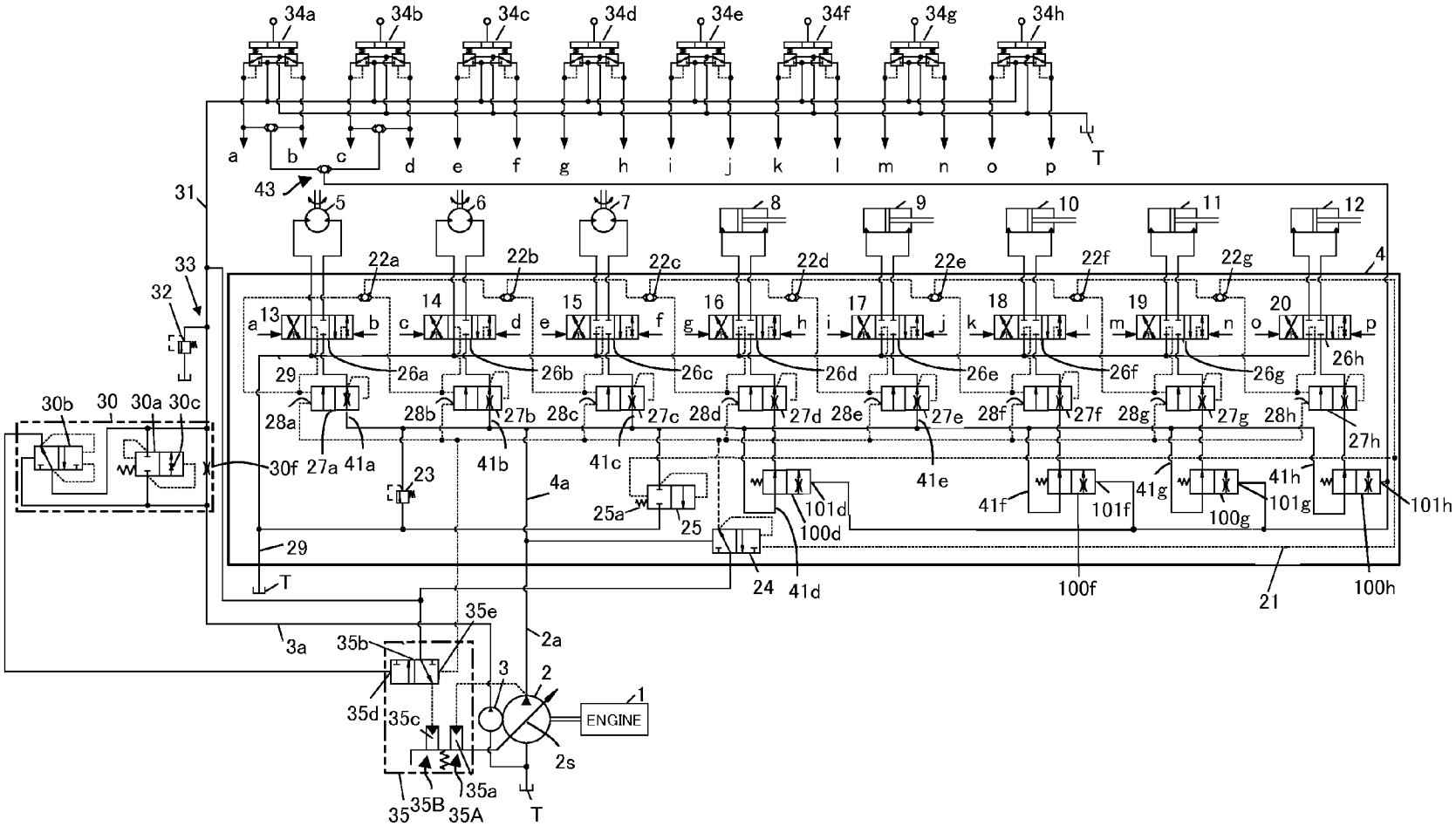
FIG. 7 is a diagram showing a hydraulic driving system of a hydraulic excavator according to a fifth embodiment of the present invention.

A hydraulic driving system according to a fifth embodiment of the present invention is shown in FIG. 7. Those members in FIG. 7 that are equivalent to the elements shown in FIG. 1 are each assigned the same reference number as used in FIG. 1, and overlapped description of the equivalent members is omitted herein. The present embodiment employs a control valve in a hydraulic fluid line lying at an upstream side of a pressure compensating valve, whereby during the combined operations control for traveling, flow rates of a hydraulic fluid supplied to the blade cylinder 8 as well as the boom cylinder 10, the arm cylinder 11, and the bucket cylinder 12 can be suppressed.

More specifically, whereas the first embodiment shown in FIG. 1 includes the control valves 100*f*, 100*g*, and 100*h* arranged in the parallel fluid lines 41*f*, 41*g*, and 41*h* respectively with the pressure compensating valves 27*g* and 27*h* arranged therein for the boom and the bucket respectively, the hydraulic driving system of the fifth embodiment includes a control valve 100*d* in a hydraulic fluid line 41*d* having a pressure compensating valve 27*d* disposed therein for the blade.

The control valve 100*d*, as with the control valves 100*f*, 100*g*, and 100*h*, has two positions, namely a fully open communicating position and a restricting position in which the valve reduces an opening area. When no operations are being carried out upon the operating device 34*a* or 34*b* for traveling, the control valve 100*d* is in the fully open communicating position shown as a left position of the valve in FIG. 7, and when the operating device 34*a* or 34*b* for traveling is operated through a full stroke, a hydraulic signal denoting a magnitude of an operating pilot pressure for traveling is guided into a pressure receiving portion 101*d* and the control valve 100*d* is switched to the restricting position shown as a right position of the valve in FIG. 7. When the control valve 100*d* is switched to the restricting position, the parallel fluid line 41*d* is reduced in flow passage area and the flow control valve 26*d* is limited in the flow rate of the fluid passing therethrough.

In the conventional system configurations with a pressure compensating valve of the type where the valve does not fully close at the stroke end in the opening-area reduction direction even during abrupt operation of a blade-operating device for traveling 34*d*, a possible instantaneous or momentary flow of the hydraulic fluid into the blade cylinder 8 may lead to a slowdown of traveling, hence causing a bodily sensory shock to the operator, and undermining his or her operation feeling.

In the present embodiment, however, as is the case in which the control lever of either the boom, the arm, or the bucket is operated for the front operation during traveling, since the control valve 100*d* suppresses the flow rate of the hydraulic fluid supplied to the blade cylinder 8, a necessary amount of hydraulic fluid is reliably supplied to the track motor 5 or 6 and a slowdown of traveling is prevented. An operation feeling can therefore be improved.

Sixth Embodiment

Figure 8:
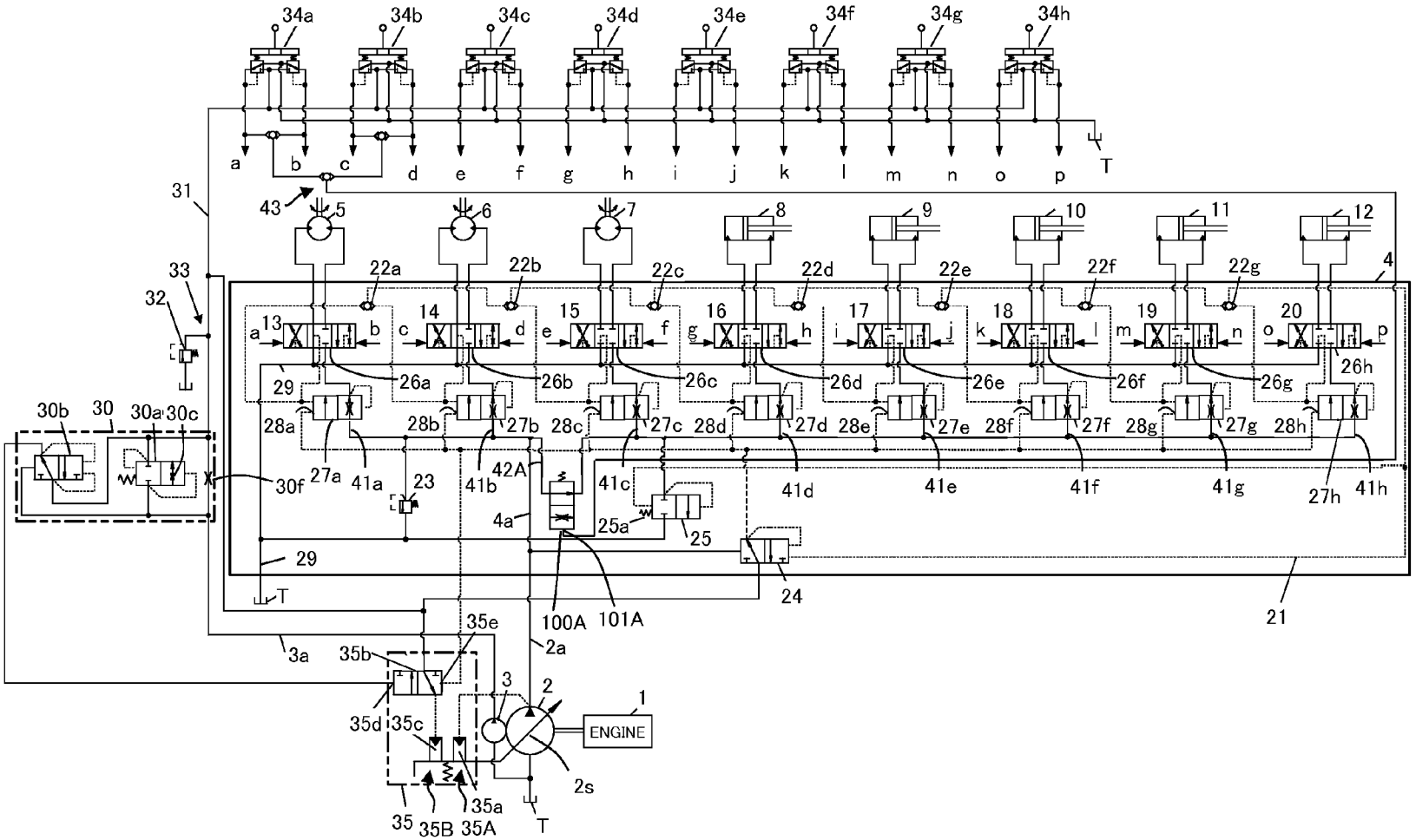
FIG. 8 is a diagram showing a hydraulic driving system of a hydraulic excavator according to a sixth embodiment of the present invention.

A hydraulic driving system according to a sixth embodiment of the present invention is shown in FIG. 8. Those members in FIG. 8 that are equivalent to the elements shown in FIG. 1 are each assigned the same reference number as used in FIG. 1, and overlapped description of the equivalent members is omitted herein. In the present embodiment, layout of the control valves in the second embodiment of FIG. 4 is changed. Thus, during the combined operations control for traveling, flow rates of a hydraulic fluid supplied to all actuators 7 to 12 except for traveling, as well as to the boom cylinder 10, the arm cylinder 11, and the bucket cylinder 12, can be suppressed.

In the second embodiment of FIG. 4, one control valve, 100 is disposed in a fluid line portion of the supply fluid line 4*a* connected to the supply fluid line 2*a* of the main pump 2, the fluid line portion being the fluid line portion 42 lying upstream relative to the branching position of the parallel fluid lines 41*f*, 41*g*, and 41*h* with the pressure compensating valves 27*f*, 27*g*, and 27*h* arranged therein for the boom, the arm, and the bucket, respectively. In the hydraulic driving system of the sixth embodiment, however, one control valve, 100A, fitted with a pressure receiving portion 101A, is disposed in a fluid line portion 42A lying upstream relative to the most upstream branching position of parallel fluid lines 41*c* to 41*h* with pressure compensating valves 27*c* to 27*h* arranged therein for non-traveling elements.

In the present embodiment of the above configuration, when the operating device 34*a* or 34*b* for traveling is operated through a full stroke, the operating pilot pressure for traveling is generated, whereby the control valve 100A switches to a restricting position shown as a lower position in FIG. 8 and thereby limits the flow rates of the fluid passing through the flow control valves 26*f* to 26*h*. Supply of the fluid to all the actuators 7 to 12, except for the actuators for traveling, is correspondingly suppressed. This ensures a necessary supply of hydraulic fluid to the track motor 5 or 6, prevents a stop of traveling, and provides appropriate combined-operations controllability.

Others

The embodiments that have been described above may each be changed and modified in various forms without departing from the spirit and scope of the present invention.

Figure 9A:
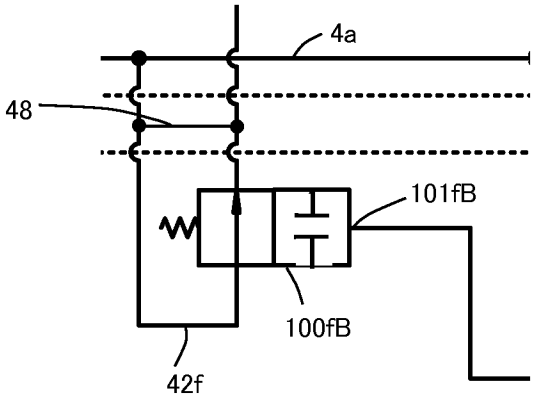
FIG. 9A is a diagram showing a modification of a control valve which reduces a flow passage area of a hydraulic fluid line portion when a specific operating device is operated, the control valve being disposed in a parallel hydraulic fluid line.
Figure 9B:
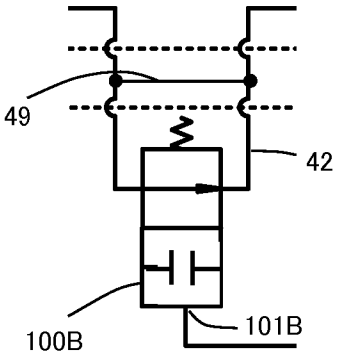
FIG. 9B is a diagram showing a modification of another control valve which reduces the flow passage area of a hydraulic fluid line portion when a specific operating device is operated, the control valve being disposed in an intra-valve supply fluid line connected to a supply fluid line of a main pump.

For example, in each embodiment of the present invention, the control valves that reduce the flow passage areas of the fluid line portions during operations on specific operating devices are employed and these control valves (e.g., 100*f*, 100*g*, and 100*h*) each have a fully open communicating position and a restricting position for reducing the opening area of the valve. Each of the control valves is constructed so that when no operations are being carried out upon the operating device 34*a* or 34*b* for traveling, the control valve is in the fully open communicating position, and so that when the operating device 34*a* or 34*b* for traveling is operated, the control valve is switched to the restricting position to reduce the flow passage area of the corresponding fluid line portion. This construction of the control valves, however, is not always limited. FIGS. 9A and 9B are diagrams that show other examples of a control valve which reduces a flow passage area of a hydraulic fluid line portion when a specific operating device is operated. FIG. 9A shows an example of a control valve disposed in the parallel hydraulic fluid line 41*f* or the like, and FIG. 9B shows an example of a control valve disposed in the fluid line portion 42 of the supply fluid line 4*a* connected to the supply fluid line 2*a* of the main pump 2. As shown in FIGS. 9A and 9B, a bypass fluid line 48 or 49 is disposed in the parallel fluid line 41*f* or in the fluid line portion 42 of the supply fluid line 4*a*, the bypass fluid line 48 or 49 has a flow passage area smaller than that of the parallel fluid line 41*f* or the fluid line portion 42 of the supply fluid line 4*a*, and the bypass fluid line 48 or 49 is endowed with a restriction effect equivalent to that achievable when a control valve 100*f* in a restricting position. A control valve 101*f*B or 100B, on the other hand, has a fully open communicating position and a fully closing position, and is constructed to be in the fully open communicating position when no operations are being carried out upon the operating device 34*a* or 34*b* for traveling, and to be switched to the closing position when the operating device 34*a* or 34*b* for traveling is operated. When the control valve 101*f*B or 100B is switched to the closing position, upstream and downstream portions of the control valve 101*f*B or 100B in the parallel fluid line 41*f* or the fluid line portion 42 are made to communicate only in the bypass fluid line 48 or 49 having a restriction effect. This construction of the control valve 101*f*B or 100B allows the valve to reduce the flow passage area of the parallel fluid line 41*f* or that of the fluid line portion 42 of the supply fluid line 4*a* when a specific operating device is operated. This reduction in flow passage area yields substantially the same favorable effect as achieved using the control valve 100*f*B or the like or the control valve 100 or the like.

In addition, while each embodiment of the present invention has been described taking a track motor as an example of a specific actuator, substantially the same advantageous effects can likewise be obtained for elements other than the track motor. To be more specific, substantially the same advantageous effects can likewise be obtained by applying the present invention to a hydraulic driving system having pressure compensating valves of a type not closing at a stroke end of the valve as operated in a direction to reduce its opening area, the system further having actuators including an actuator likely to stop operating if, during the combined operations control likely to generate a particularly significant difference in load pressure between any two actuators, saturation occurs and a large portion of the delivered fluid from the main pump is absorbed by the actuator with the lower load pressure. For example, since a load pressure upon a standby actuator provided on an attachment such as a crusher tends to increase, if the present invention is applied with a standby actuator as a specific actuator, then during the combined operations control where the standby actuator is driven simultaneously with actuators other than the specific actuator (e.g., the boom, the arm, or the bucket), the flow rate demanded from each of the actuators other than the specific actuator can be limited and the hydraulic fluid can be supplied to the standby actuator preferentially.

Furthermore, while each embodiment of the present invention has been described taking a hydraulic excavator as an example of a construction machine, substantially the same advantageous effects can likewise be obtained by applying the invention to other construction machines such as a hydraulic crane or wheeled excavator.

DESCRIPTION OF REFERENCE NUMBERS

1: Engine
2: Hydraulic pump (Main pump)
2*a*: Supply fluid line
3: Pilot pump
3*a*: Supply fluid line
4: Control valve
4*a*: Intra-valve supply fluid line
5 to 12: Actuators
5 and 6: Track motors (Specific actuators)
7: Swing motor
8: Blade cylinder
9: Swing cylinder
10: Boom cylinder
11: Arm cylinder
12: Bucket cylinder
13-20: Valve sections
21: Signal fluid line
22*a* to 22*g*: Shuttle valves
23: Main relief valve
24: Differential-pressure reducing valve
25: Unloading valve
25*a*: Spring
26*a* to 26*h*: Flow control valves
27*a* to 27*h*: Pressure compensating valves
29: Intra-valve tank fluid line
30: Engine speed detection valve
30*a*: Flow detection valve
30*b*: Differential-pressure reducing valve
30*c*: Variable restrictor
30*f*: Fixed restrictor
31: Pilot hydraulic fluid line
32: Pilot relief valve
33: Pilot hydraulic fluid source
34*a* to 34*h*: Operating devices
34*a*-1 to 34*h*-1: Control levers
34*a*-2 to 34*h*-2: Remote control valves
35: Pump control unit
35A: Pump torque controller

35B: LS controller
35*a*: Torque control tilting actuator
35*b*: LS control valve
35*c*: LS control tilting actuator
35*d* and 35*e*: Pressure receiving portions
41*a* to 41*h*: Parallel fluid lines
42 and 42A: Fluid line portions
43 and 43A: Manipulation detectors
46*f*, 46*g*, and 46*h*: Solenoid-operated control valves
48: Bypass fluid line
49: Bypass fluid line
71: Controller
72: Pressure sensor
81: Manual selector
83: Solenoid-operated control valve
100*f*, 100*g*, and 100*h*: Control valves
101*f*, 100*g*, and 101*h*: Pressure receiving portions
100: Control valve
101: Pressure receiving portion
100*d*: Control valve
101*d*: Pressure receiving portion
100A: Control valve
101A: Pressure receiving portion
100*f*B: Control valve
101*f*B: Pressure receiving portion
100B: Control valve
101B: Pressure receiving portion
300: Upper swing structure
301: Lower track structure
302: Front working implement
303: Swing post
304: Center frame
305: Blade
306: Boom
307: Arm
308: Bucket
310 and 311: Crawlers

The invention claimed is:

1. A hydraulic driving system for a construction machine, comprising:

a variable-displacement type of hydraulic pump;

a plurality of actuators each driven by a hydraulic fluid delivered from the hydraulic pump;

a plurality of flow control valves that each control a flow rate of the hydraulic fluid supplied from the hydraulic pump to a corresponding one of the actuators;

a plurality of operating devices disposed in association with the actuators, each of the operating devices including a remote control valve configured to generate an operating pilot pressure for driving a corresponding one of the flow control valves;

a plurality of pressure compensating valves each for controlling a differential pressure across a corresponding one of the flow control valves independently; and a pump control unit for controlling a capacity of the hydraulic pump by means of load-sensing control so that a fluid delivery pressure of the hydraulic pump becomes higher by a target differential pressure than a load pressure of an actuator to which the highest load pressure is to be assigned among the plurality of actuators; wherein:

the pressure compensating valves are each a pressure compensating valve of a type not fully closing at a stroke end of the valve as operated in a direction to decrease in opening area;

the plurality of actuators include a specific actuator that undergoes a higher load pressure during combined operations control when the specific actuator is driven simultaneously with actuators other than the specific actuator;

a control valve is disposed in hydraulic fluid line portions upstream or downstream relative to a pressure compensating valve of the actuator other than the specific actuator, the control valve reducing a flow passage area of the hydraulic fluid line portion upon operation of a specific operating device, among the plurality of operating devices, that relates to the specific actuators;

the plurality of pressure compensating valves are each disposed in a corresponding one of a plurality of parallel hydraulic fluid lines branching from a supply fluid line connected to the hydraulic pump; and the hydraulic fluid line portion is part of the supply fluid line, the hydraulic fluid line portion lying upstream relative to a branching position of the parallel hydraulic fluid line where the pressure compensating valve relating to one of the actuators other than the specific actuator is disposed.

2. The hydraulic driving system according to claim 1, further comprising:

a shuttle valve configured to detect an operating pilot pressure generated by a remote control valve of the specific operating device, and output the detected pressure as a hydraulic signal;

wherein the control valve is a hydraulic control valve switched by the hydraulic signal.

3. The hydraulic driving system according to claim 1, further comprising:

a pressure sensor configured to detect an operating pilot pressure generated by a remote control valve of the specific operating device, and output an electrical signal;

wherein the control valve is a solenoid-operated control valve that operates in accordance with the electrical signal.

4. The hydraulic driving system according to claim 1, further comprising:

a manual selector adapted to be switched between a first position and a second position; and a controller configured so that when the manual selector is in the first position, the controller activates a function of the control valve that reduces the flow passage area of the hydraulic fluid line portion, with the specific operating device being operated, and when the manual selector is switched to the second position, the controller deactivates the function of the control valve that reduces the flow passage area of the hydraulic fluid line portion, with the specific operating device being operated.

5. The hydraulic driving system according to claim 1, wherein:

the specific actuator is a track motor that drives a track structure of the construction machine; and each of the actuators other than the specific actuator is one of the plurality of hydraulic cylinders which actuate a front working implement of the construction machine, or otherwise a blade cylinder that actuates a blade.

6. A hydraulic driving system for a construction machine, comprising:

a variable-displacement type of hydraulic pump;

a plurality of actuators each driven by a hydraulic fluid delivered from the hydraulic pump;

a plurality of flow control valves that each control a flow rate of the hydraulic fluid supplied from the hydraulic pump to a corresponding one of the actuators;

a plurality of operating devices disposed in association with the actuators, each of the operating devices including a remote control valve configured to generate an operating pilot pressure for driving a corresponding one of the flow control valves;

a plurality of pressure compensating valves each for controlling a differential pressure across a corresponding one of the flow control valves independently; and a pump control unit for controlling a capacity of the hydraulic pump by means of load-sensing control so that a fluid delivery pressure of the hydraulic pump becomes higher by a target differential pressure than a load pressure of an actuator to which the highest load pressure is to be assigned among the plurality of actuators; wherein:

the pressure compensating valves are each a pressure compensating valve of a type not fully closing at a stroke end of the valve as operated in a direction to decrease in opening area;

the plurality of actuators include a specific actuator that undergoes a higher load pressure during combined operations control when the specific actuator is driven simultaneously with actuators other than the specific actuator;

a control valve is disposed in hydraulic fluid line portions upstream or downstream relative to a pressure compensating valve of the actuator other than the specific actuator, the control valve reducing a flow passage area of the hydraulic fluid line portion upon operation of a specific operating device, among the plurality of operating devices, that relates to the specific actuator further comprising:

a manual selector adapted to be switched between a first position and a second position; and a controller configured so that when the manual selector is in the first position, the controller activates a function of the control valve that reduces the flow passage area of the hydraulic fluid line portion, with the specific operating device being operated, and when the manual selector is switched to the second position, the controller deactivates the function of the control valve that reduces the flow passage area of the hydraulic fluid line portion, with the specific operating device being operated.

* * * * *